US009104139B2

(12) United States Patent
Hoshi et al.

(10) Patent No.: US 9,104,139 B2
(45) Date of Patent: Aug. 11, 2015

(54) DEVELOPING DEVICE, PROCESS CARTRIDGE, REMANUFACTURING METHOD FOR DEVELOPING DEVICE AND PROCESS CARTRIDGE

(75) Inventors: Nobuharu Hoshi, Yokohama (JP); Akira Suzuki, Naka-gun (JP); Makoto Hayashida, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 792 days.

(21) Appl. No.: 13/108,132

(22) Filed: May 16, 2011

(65) Prior Publication Data

US 2011/0286762 A1 Nov. 24, 2011

(30) Foreign Application Priority Data

May 18, 2010 (JP) ..... 2010-114478
Apr. 5, 2011 (JP) ..... 2011-083782

(51) Int. Cl.
*G03G 15/08* (2006.01)
*G03G 21/18* (2006.01)

(52) U.S. Cl.
CPC ..... *G03G 15/0894* (2013.01); *G03G 21/181* (2013.01); *G03G 15/0812* (2013.01); *G03G 15/0817* (2013.01); *G03G 15/0898* (2013.01); *G03G 2215/00987* (2013.01); *G03G 2215/0866* (2013.01)

(58) Field of Classification Search
CPC ..... G03G 15/0894; G03G 15/0898
USPC ..... 399/103, 105
See application file for complete search history.

(56) References Cited

U.S. PATENT DOCUMENTS

| | | | | |
|---|---|---|---|---|
| 5,809,374 | A * | 9/1998 | Tsuda et al. | 399/111 |
| 8,620,177 | B2 * | 12/2013 | Carot | 399/103 |
| 8,682,211 | B2 * | 3/2014 | Hoshi et al. | 399/103 |
| 2002/0028087 | A1 * | 3/2002 | Higeta et al. | 399/109 |
| 2009/0245851 | A1 * | 10/2009 | Hoshi et al. | 399/103 |
| 2010/0092206 | A1 * | 4/2010 | Matsushita et al. | 399/103 |
| 2010/0150604 | A1 * | 6/2010 | Hayashida et al. | 399/105 |
| 2011/0170903 | A1 * | 7/2011 | Hoshi et al. | 399/105 |
| 2014/0093271 | A1 * | 4/2014 | Hoshi | 399/103 |
| 2014/0119771 | A1 * | 5/2014 | Li | 399/109 |
| 2014/0133882 | A1 * | 5/2014 | Kim et al. | 399/103 |
| 2014/0140723 | A1 * | 5/2014 | Hoshi et al. | 399/103 |
| 2014/0178093 | A1 * | 6/2014 | Nishiwaki et al. | 399/103 |

FOREIGN PATENT DOCUMENTS

| | | | |
|---|---|---|---|
| CN | 1333483 | A | 1/2002 |
| JP | 07-121085 | A | 5/1995 |
| JP | 2001-125469 | A | 5/2001 |
| JP | 2002-014593 | A | 1/2002 |
| JP | 2005-274819 | A | 10/2005 |

* cited by examiner

*Primary Examiner* — David Gray
*Assistant Examiner* — Geoffrey Evans
(74) *Attorney, Agent, or Firm* — Canon USA Inc IP Division

(57) ABSTRACT

A remanufacturing method for a developing device and a process cartridge includes a dismounting step of dismounting a regulating member from a development frame member, a cleaning step of cleaning a blade sealing member, and a mounting step of mounting the regulating member to the development frame member after the cleaning step.

12 Claims, 25 Drawing Sheets

DEVELOPING DEVICE, PROCESS CARTRIDGE, REMANUFACTURING METHOD FOR DEVELOPING DEVICE AND PROCESS CARTRIDGE

BACKGROUND OF THE INVENTION

1. Field of the Invention

Embodiments relate to a developing device for use in an electrophotographic image forming apparatus for forming an image on a recording medium, and a process cartridge dismountably mountable to the electrophotographic image forming apparatus, and a remanufacturing method therefor.

A process cartridge is a cartridge in which a developing unit and an electrophotographic photosensitive member are integrally made into a cartridge, which is made dismountably mountable to an image forming apparatus main body. A developing device is a device which develops an electrostatic latent image formed on the electrophotographic photosensitive member by using a developer.

The electrophotographic image forming apparatus forms an image on the recording medium by using an electrophotographic image forming process. Examples of an electrophotographic image forming apparatus include an electrophotographic copying machine, an electrophotographic printer (e.g., a laser printer, a light-emitting diode (LED) printer, etc.), and a facsimile apparatus, and so on.

2. Description of the Related Art

Conventionally, in an electrophotographic image forming apparatus using an electrophotographic image forming process, the electrophotographic photosensitive member and the process unit are integrally unitized into a process cartridge. The process cartridge is made dismountably mountable to the image forming apparatus main body.

In addition, such a process cartridge serves to form an image on a recording medium by using a toner (developer). Therefore, the toner is consumed as images are repetitively formed. When the toner has been consumed to the extent that it becomes impossible to form the image of satisfactory quality, the process cartridge loses a commercial value as the process cartridge.

Heretofore, a simple remanufacturing method for remanufacturing the process cartridge which can commercialize again the process cartridge having lost a commercial value as a result of consumption of the toner contained therein is discussed in Japanese Patent Application Laid-Open No. 2001-125469.

SUMMARY OF THE INVENTION

Embodiments are directed to a simple remanufacturing method for remanufacturing a developing device or a process cartridge.

Further, embodiments are directed to a remanufacturing method for remanufacturing a developing device or a process cartridge which can commercialize again the developing device or the process cartridge which has been used to the extent that it becomes impossible to form the image of satisfactory quality for the user of the process cartridge.

Further, embodiments are directed to a developing device or a process cartridge that can be remanufactured in a simple manner.

According to an embodiment, a remanufacturing method for a developing device including a developing roller for developing an electrostatic latent image formed on a photosensitive member by using a developer, a developer accommodating unit configured to accommodate the developer, a regulating member configured to regulate a layer thickness of the developer applied by the developing roller, a development frame member configured to support the regulating member, the development frame member having end sealing members provided at each end side thereof, a blade sealing member made of an elastomer resin, configured to seal between the regulating member and the development frame member to prevent the developer from leaking, the blade sealing member configured to be molded into the development frame member abut against a surface of the developing roller to prevent the developer from leaking, the blade sealing member being formed by injecting elastomer resin into a seal forming portion of the development frame member by a mold from an injection port thereby contacting each of the end sealing members. The method includes (i) dismounting the regulating member from the development frame member, (ii) cleaning the blade sealing member after the regulating member dismounting, and (iii) mounting the regulating member to the development frame member after the sealing member cleaning.

According to another aspect of the present invention, a remanufacturing method for a process cartridge including a photosensitive member unit having a photosensitive member, a developing unit that is coupled to the photosensitive member unit, the developing unit having a developing roller for developing an electrostatic latent image formed on the photosensitive member by using a developer, a developer accommodating unit configured to accommodate the developer, a regulating member configured to regulate a layer thickness of the developer applied on the developing roller, a development frame member configured to support the regulating member, the development frame member having end sealing members provided at each end side thereof, and a blade sealing member made of an elastomer resin, configured to seal between the regulating member and the development frame member to prevent the developer from leaking, the blade sealing member configured to be molded into the development frame member to abut against a surface of the developing roller to prevent the developer from leaking, the blade sealing member being formed by injecting elastomer resin into a seal forming portion of the development frame member by a mold from an injection port thereby contacting each of the end sealing members, and includes (i) separating the photosensitive member unit and the developing unit from each other, (ii) dismounting the regulating member from the development frame member after the separating, (iii) cleaning the blade sealing member after the regulating member dismounting, (iv) mounting the regulating member to the development frame member after the sealing member cleaning, and (v) coupling the photosensitive member unit and the developing unit together after the regulating member mounting.

According to yet another aspect of the present invention, a remanufacturing method for a developing device including a developing roller for developing an electrostatic latent image formed on a photosensitive member by using a developer, a developer accommodating unit configured to accommodate the developer, a regulating member configured to regulate a layer thickness of the developer applied by the developing roller, a development frame member configured to support the regulating member, the development frame member having end sealing members provided at each end side thereof, and a blade sealing member made of an elastomer resin, configured to seal between the regulating member and the development frame member to prevent the developer from leaking, the blade sealing member configured to be molded, into the development frame member to abut against a surface of the developing roller to prevent the developer from leaking, the blade sealing member being formed by injecting elastomer resin into a seal forming portion of the development frame member by a mold from an injection port thereby contacting each of the end sealing members, and includes (i) dismounting the regulating member from the development frame member, (ii) attaching, to the regulating member, an adhesive member which comes into contact with the blade sealing member when the regulating member is mounted to the development frame member, after the regulating member dismounting, and (iii) mounting the regulating member to the development frame member after the adhesive member mounting.

According to yet another aspect of the present invention, a remanufacturing method for a process cartridge including a photosensitive member unit having a photosensitive member, a developing unit coupled to the photosensitive member unit, the developing unit having a developing roller for developing an electrostatic latent image formed on the photosensitive member by using a developer, a developer accommodating unit configured to accommodate the developer, a regulating member configured to regulate a layer thickness of the developer applied on the developing roller, a development frame member configured to support the regulating member, the development frame member having end sealing members provided at each end side thereof, and a blade sealing member made of an elastomer resin, configured to seal between the regulating member and the development frame member to prevent the developer from leaking, the blade sealing member configured to be molded into the development frame member to abut against a surface of the developing roller to prevent the developer from leaking, the blade sealing member being formed by injecting elastomer resin into a seal forming portion of the development frame member by a mold from an injection port thereby contacting each of the end sealing members, and includes (i) separating the photosensitive member unit and the developing unit from each other, (ii) dismounting the regulating member from the development frame member after the separating, (iii) attaching, to the regulating member, an adhesive member which comes into contact with the blade sealing member when the regulating member is mounted to the development frame member, after the regulating member dismounting, (iv) mounting the regulating member to the development frame member, after the sealing member mounting, and (v) coupling the photosensitive member unit and the developing unit together, after the regulating member mounting.

According to yet another aspect of the present invention, a remanufacturing method for a developing device including a developing roller for developing an electrostatic latent image formed on a photosensitive member by using a developer, a developer accommodating unit configured to accommodate the developer, a first regulating member configured to regulate a layer thickness of the developer applied by the developing roller, a development frame member configured to support the first regulating member, the development frame member having end sealing members provided at each end side thereof, and a blade sealing member made of an elastomer resin, configured to seal between the first regulating member and the development frame member to prevent the developer from leaking, the blade sealing member configured to be molded into the development frame member to abut against a surface of the developing roller to prevent the developer from leaking, the blade sealing member being formed by injecting elastomer resin into a seal forming portion of the development frame member by a mold from an injection port thereby contacting each of the end sealing members, and includes (i) a dismounting the first regulating member from the development frame member, (ii) mounting a second regulating member provided with an adhesive member, the adhesive member coming into contact with the blade sealing member when the second regulating member is mounted to the development frame member, after the dismounting of the first regulating member.

According to yet another aspect of the present invention, a remanufacturing method for a process cartridge including a photosensitive member unit having a photosensitive member, a developing unit that is coupled to the photosensitive member unit, the developing unit having a developing roller for developing an electrostatic latent image formed on the photosensitive member by using a developer, a developer accommodating unit configured to accommodate the developer, a first regulating member configured to regulate a layer thickness of the developer applied on the developing roller, a development frame member configured to support the first regulating member, the development frame member having end sealing members provided at each end side thereof, and a blade sealing member made of an elastomer resin, configured to seal between the first regulating member and the development frame member to prevent the developer from leaking, the blade sealing member configured to be molded into the development frame member to abut against a surface of the developing roller to prevent the developer from leaking, the blade sealing member being formed by injecting elastomer resin into a seal forming portion of the development frame member by a mold from an injection port thereby contacting each of the end sealing members, and includes (i) separating the photosensitive member unit and the developing unit from each other, (ii) dismounting the first regulating member from the development frame member after the separating, (iii) mounting a second regulating member provided with an adhesive member, the adhesive member coming into contact with the blade sealing member when the second regulating member is mounted to the development frame member, after the dismounting of the first regulating member, and (v) coupling the photosensitive member unit and the developing unit together after the mounting of the second regulating member.

According to yet another aspect of the present invention, a developing device used in an image forming apparatus includes a developing roller for developing an electrostatic latent image formed on a photosensitive member by using a developer, a developer accommodating unit configured to accommodate the developer, a regulating member configured to regulate a layer thickness of the developer applied by the developing roller, a development frame member configured to support the regulating member, the development frame member having end sealing members provided at each end side thereof, and a blade sealing member made of an elastomer resin, configured to seal between the regulating member and the development frame member to prevent the developer from leaking, the blade sealing member configured to be molded into the development frame member to abut against a surface of the developing roller to prevent the developer from leaking, the blade sealing member being formed by injecting elastomer resin into a seal forming portion of the development frame member by a mold from an injection port thereby contacting each of the end sealing members, wherein the blade sealing member comes into contact with an adhesive member which has been attached to the regulating member.

According to yet another aspect of the present invention, a process cartridge dismountably mountable to an image forming apparatus includes a photosensitive member, a developing roller for developing an electrostatic latent image formed on the photosensitive member by using a developer, a developer accommodating unit configured to accommodate the developer, a regulating member configured to regulate a layer thickness of the developer applied by the developing roller, a development frame member configured to support the regulating member, the development frame member having end sealing members provided at each end side thereof, and a blade sealing member made of an elastomer resin, configured to seal between the regulating member and the development frame member to prevent the developer from leaking, the blade sealing member configured to be molded into the development frame member to abut against a surface of the developing roller to prevent the developer from leaking, the blade sealing member being formed by injecting elastomer resin into a seal forming portion of the development frame member by a mold from an injection port thereby contacting each of the end sealing members, wherein the blade sealing member comes into contact with an adhesive member which has been attached to the regulating member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Hereinbelow, a developing device and a process cartridge according to an exemplary embodiment of the present invention will be described in detail with reference to the drawings. In the descriptions hereinbelow, the lengthwise direction of the process cartridge is a direction intersecting (substantially orthogonal direction, a rotational axis direction of a photosensitive member drum) a direction in which the process cartridge is mounted on the electrophotographic image forming apparatus. Left and right of the process cartridge is left or right as viewed from a direction in which the process cartridge is mounted on the electrophotographic image forming apparatus. The top surface of the process cartridge is a surface located top in a state where the process cartridge is mounted on the electrophotographic image forming apparatus, and a bottom surface is a surface located bottom.

First, a general configuration of the electrophotographic image forming apparatus and the process cartridge will be briefly described with reference to FIG. 1 and FIG. 2.

Figure 1:
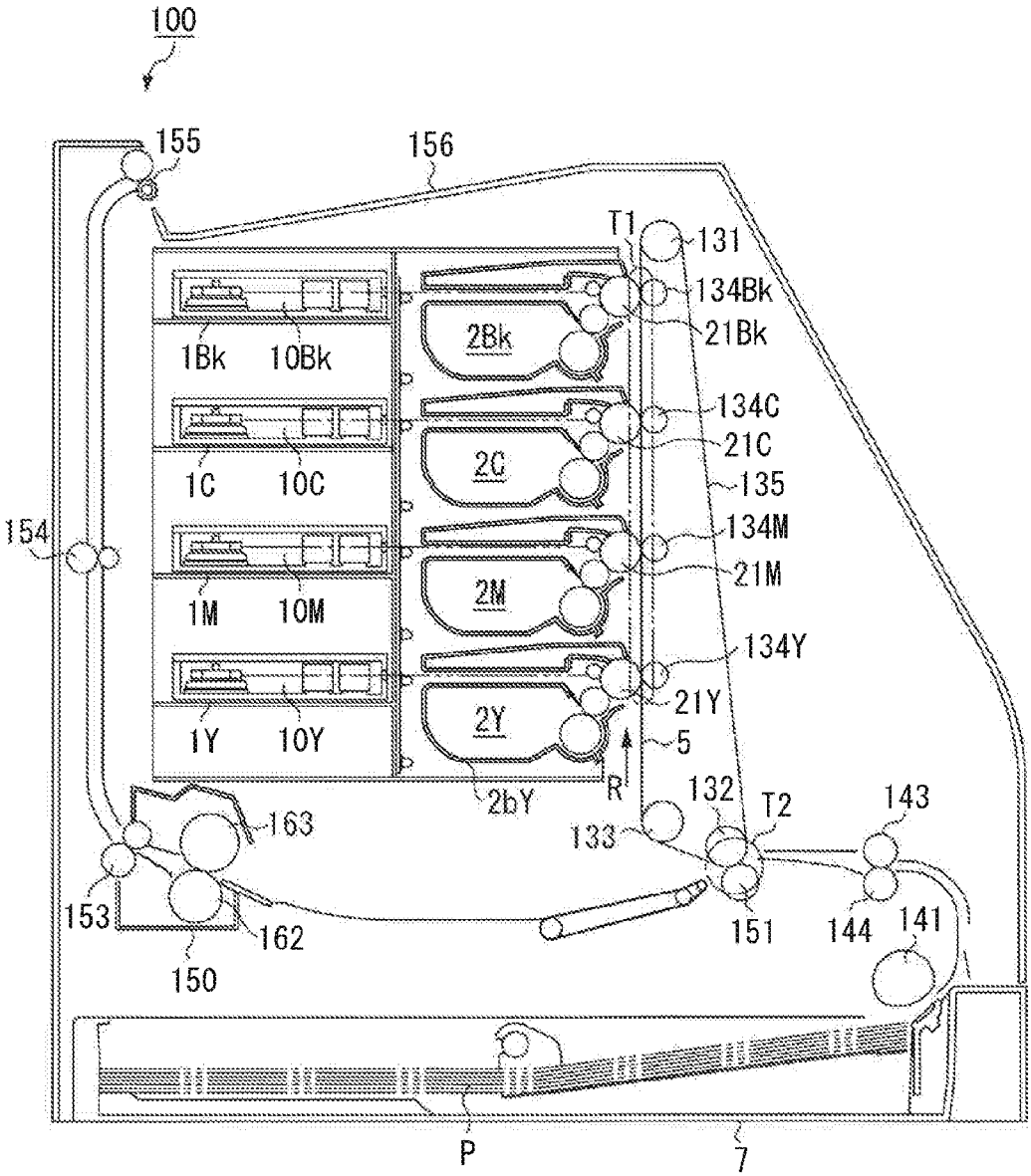
FIG. 1 is a schematic cross-sectional view illustrating a general configuration of an image forming apparatus according to an exemplary embodiment of the present invention.

FIG. 1 is a schematic cross-sectional view illustrating a general configuration of a color laser beam printer (hereinafter referred to as an "image forming apparatus") which is an example of the electrophotographic image forming apparatus. FIG. 2 is a schematic cross-sectional view of the process cartridge according to the first exemplary embodiment of the present invention.

In an image forming apparatus 100, as illustrated in FIG. 1, four process cartridges 2 (2Y, 2M, 2C, 2Bk) are arranged in a vertical direction. In the present exemplary embodiment, the process cartridges 2 are image forming units for yellow (Y) toner, magenta (M) toner, cyan (C) toner, and black (Bk) toner, respectively. The process cartridges 2 have, as illustrated in FIG. 1 and FIG. 2, rotational drum type electrophotographic photosensitive members (hereinafter, referred to as a "photosensitive member drums" or "photosensitive drums") 21 (21Y, 21M, 21C, 21Bk), as an image bearing member, respectively. A charging roller 23 as a charging unit, and a developing unit 2*b* as a developing unit are arranged, around each of photosensitive member drums 21. Furthermore, a cleaning blade 28 as a cleaning unit is arranged around the photosensitive member drum 21.

Then, in the present exemplary embodiment, the photosensitive member drum 21, the charging roller 23, and the cleaning blade 28 are integrally provided in a photosensitive member unit 2*a* as a cleaning unit.

Furthermore, the process cartridge 2 includes the photosensitive member unit 2*a* and the developing unit 2*b*. The process cartridges 2 for four-color are dismountably mountable with respect to the image forming apparatus 100 and each process cartridge is dismountably mountable separately.

Developer images (i.e., toner images) with different colors from one another, formed by the process cartridges 2 are sequentially transferred so as to be superimposed one on another onto an intermediate transfer belt 135 as an intermediate transfer member that constitutes a transfer apparatus 5. Accordingly, a full-color image is formed on the intermediate transfer belt 135. The intermediate transfer belt 135 can be rotated in the direction of an arrow R by rollers 131 132, and 133 provided in the transfer apparatus 5.

A transfer material P is fed from a sheet cassette 7 provided in a lower part of the image forming apparatus 100, and is conveyed in an upward direction. Then, the full-color toner image on the intermediate transfer belt 135 is collectively transferred onto the transfer material P at a secondary transfer position T2. Thereafter, the unfixed full-color image is fixed by a fixing device 150 including a heat roller 163 and a pressure roller 162. Subsequently, the transfer material P is discharged to a discharge tray 156 by a discharge roller group 153, 154, and 155.

Next, an operation when an image formation is performed by the image forming apparatus 100 that is configured as described above will be described.

First, the transfer materials P within the sheet cassette 7 are separated one by one by rotating a sheet feeding roller 141, and are conveyed to the registration roller 144. On the other hand, the photosensitive member drum 21 and the intermediate transfer belt 135 each are rotated at a predetermined peripheral speed V (hereinafter, called a process speed) in the directions of the arrow R (see FIG. 1), and an arrow W (see FIG. 2), respectively. Further, the photosensitive member drum 21 of which surface has been uniformly charged by a charging roller 23 is subjected to exposure by lasers 10 (10Y, 10M, 10C, 10Bk) from a scanner portion serving as exposure apparatuses 1 (1Y, 1M, 1C, 1Bk), thus an electrostatic latent image is formed.

Since image forming operations of respective colors are similar to one another, yellow image will be described here.

An irradiation of the laser 10Y is performed by the scanner portion 1Y, thereby a latent image is formed on the photosensitive member drum 21Y. Then, a yellow developing unit 2*b*Y is driven to perform development on the latent image on the photosensitive member drum 21Y with the yellow toner. Then, a voltage is applied to a transfer roller 134Y at a first transfer position T1, thereby a yellow toner image on the photosensitive member drum 21Y is primarily transferred to an outer peripheral surface of the intermediate transfer belt 135.

Similarly, in the process cartridges 2M, 2C, and 2Bk provided with magenta, cyan, and black toners as well, a latent image formation, a development, and a toner transfer to the intermediate transfer belt 135 are performed. Then, the full-color image composed of four types of toners of yellow, magenta, cyan, and black is formed on the surface of the intermediate transfer belt 135.

Then, the full-color image is formed on the intermediate transfer belt 135, and a bias is applied to the transfer roller 151 at the secondary transfer position T2. Accordingly, the full-color image on the intermediate transfer belt 135 is transferred collectively and simultaneously for four colors onto the transfer material P. Thereafter, the transfer material P is separated from the intermediate transfer belt 135 and is conveyed to the fixing device 150, and a toner fixation is performed thereon. After that, the transfer material P with an image side facing downwards is discharged into the discharge tray 156 located at an upper portion of the image forming apparatus 100 via the discharge roller group 153, 154, and 155, thus the image forming operation ends.

Next, the process cartridge 2 will be described in detail with reference to FIG. 2.

Respective cartridges for yellow, magenta, cyan, and black have the same configuration. Therefore, in the descriptions hereinbelow, subscripts Y, M, C, and Bk indicating respective colors will be omitted, and the process cartridges 2 of respective colors (2Y, 2M, 2C, 2Bk) will be collectively described as a cartridge 2.

The cartridge 2, as described above, is divided into the photosensitive member unit 2*a* and the developing unit 2*b*. The photosensitive member unit 2*a* is provided with the photosensitive member drum. 21, the charging roller 23, and the cleaning blade 28. In the photosensitive member unit 2*a*, the photosensitive member drum 21 is rotatably mounted onto a cleaning frame member 24. Around the photosensitive member drum 21, arranged are the charging roller 23 serving as a primary charging unit for uniformly charging a surface of the photosensitive member drum 21, and a cleaning blade 28 for removing residual developer (toner) which has remained on the photosensitive member drum 21. Furthermore, the toner removed by the cleaning blade 28 from the photosensitive member drum 21 surface, is collected in a waste toner chamber 30 provided behind the cleaning frame member 24. The photosensitive member drum 21 receives a driving force transmitted from a drive motor (not illustrated), and rotates in the direction of the arrow W according to an image forming operation.

The developing unit 2*b* includes a toner container 70A serving as the developer accommodating unit accommodating the toner therein, a developing roller 22, a development container 70B that rotatably supports the developing roller 22, a toner stirring member 74, a toner supply roller 72, and a development blade unit 73. The toner container 70A and the development container 70B are integrally formed by a development frame member 71 composed of a plurality of frame members.

The developing roller 22 rotates in the direction of an arrow Y in contact with the photosensitive member drum 21. Around the developing roller 22, the toner supply roller 72 that rotates in the direction of an arrow Z in contact with the developing roller 22, and the development blade unit 73 are arranged respectively.

The developing roller 22 and the development blade unit 73 are integrally mounted to the development frame member 71 via end sealing members 95*a* and 95*b* and a blade sealing member 94. Accordingly, this prevents the leakage of the toner contained within the development container 70B to the outside. The end sealing members 95*a* and 95*b* and the blade sealing member 94 are integrally formed to the development frame member 71, which constitutes a development frame member unit 71A. As described below, the development blade unit 73, the developing roller 22, and the toner supply roller 72 are mounted on the development frame member unit 71A, which constitutes the developing unit 2*b*.

The development blade unit 73 serving as a regulating member regulates an amount of the toner on the developing roller 22. Also, a toner stirring member 74 is provided within the toner container 70A for stirring and conveying the accommodated toner to the toner supply roller 72. Then, the developing unit 2*b* is urged by a pressure spring 29 so that the developing roller 22 comes into contact with the photosensitive member drum 21.

The accommodated toner is conveyed to the toner supply roller 72 by the toner stirring member 74 rotated and driven in the direction of the arrow X, during development operation. The toner supply roller 72 that rotates in the direction of the arrow Z, slides frictionally against the developing roller 22 that rotates in the direction of the arrow Y. Accordingly, the toner is supplied from the toner supply roller 72 to the developing roller 22, and is borne on a peripheral surface the developing roller 22. The toner applied to the developing roller 22 reaches the development blade unit 73 along with a rotation of the developing roller 22, and the development blade unit 73 regulates the toner so as to impart a desired charged-electrostatic potential, as well as to form a predetermined toner layer thickness. The regulated toner, as the developing roller 22 rotates, is conveyed to a development unit where the photosensitive member drum 21 and the developing roller 22 come into contact with each other. Then, in the development unit, the regulated toner is shifted to a surface of the photosensitive member drum 21 by a direct current development bias applied from a power supply (not illustrated) to the developing roller 22.

Next, a sealing configuration of the development frame member unit 71A will be described in detail with reference to FIG. 3 to FIGS. 8A and 8B.

Figure 3:
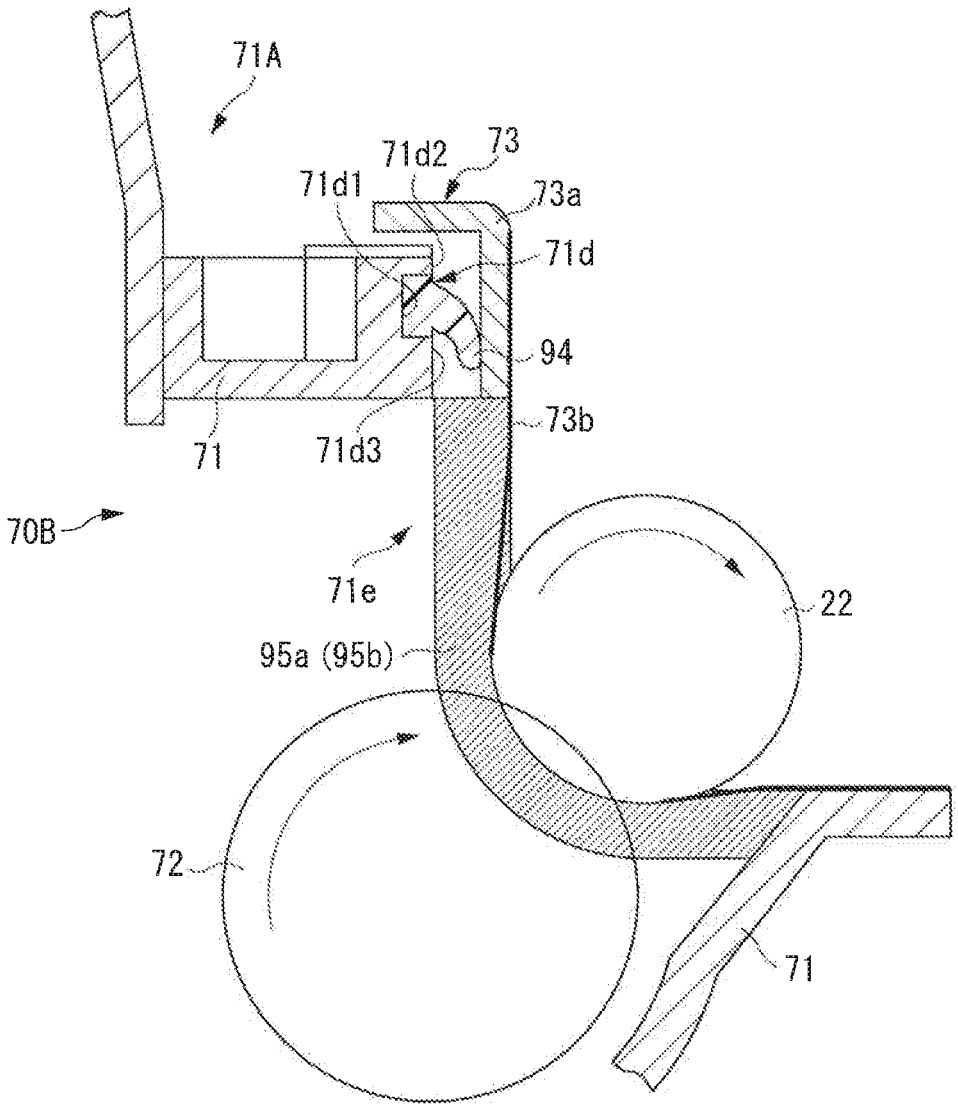
FIG. 3 is a schematic cross-sectional view of a development frame member unit.
Figure 4:
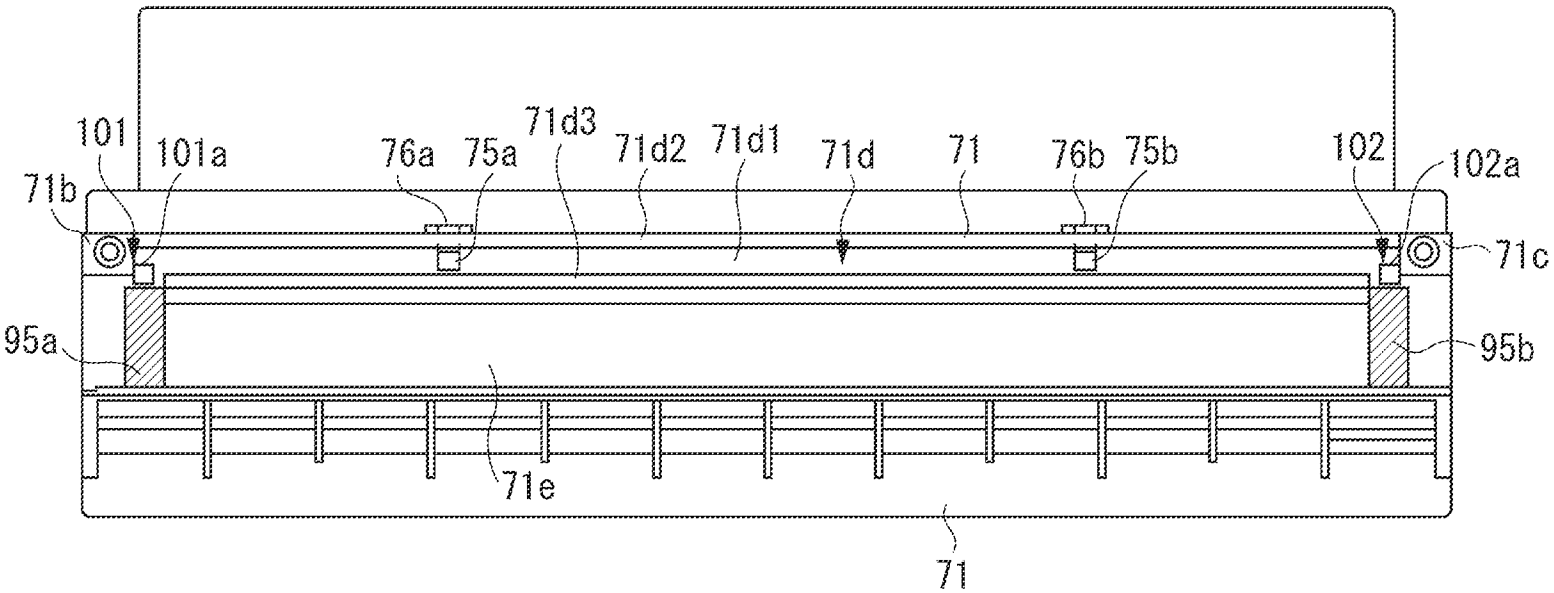
FIG. 4 is a schematic front view before molding a development blade seal of the development frame member unit.
Figure 5:
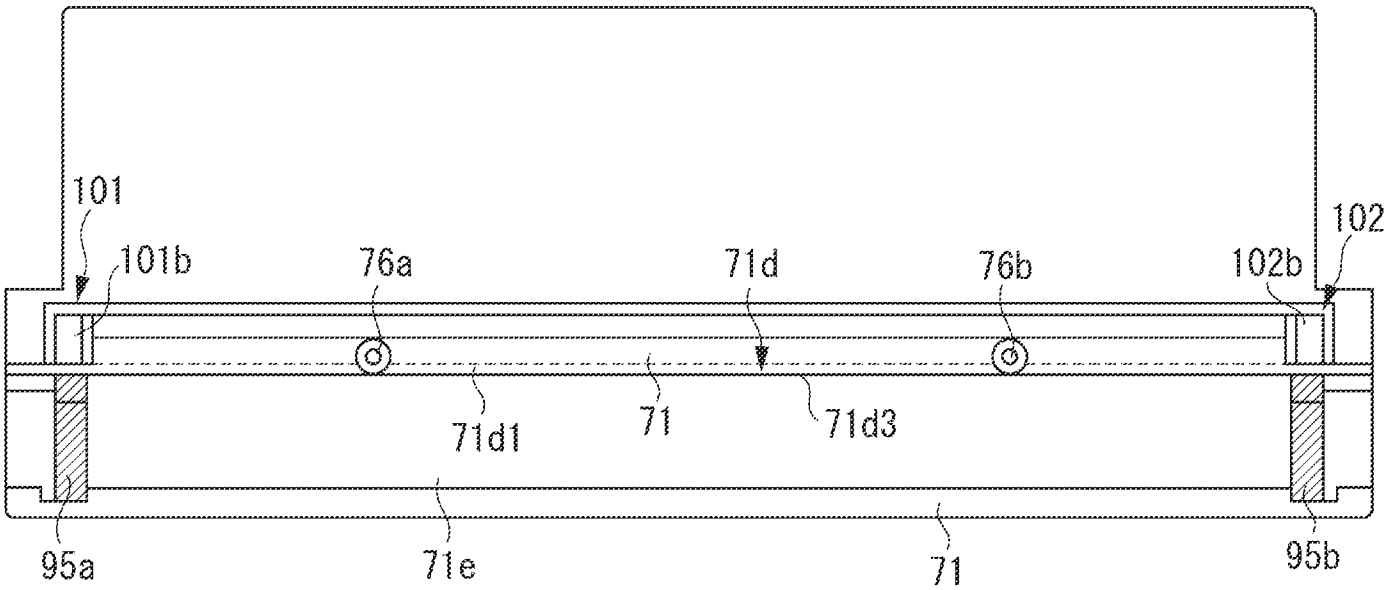
FIG. 5 is a schematic top plan view before molding the development blade seal of the development frame member unit in a developing unit.
Figure 6:
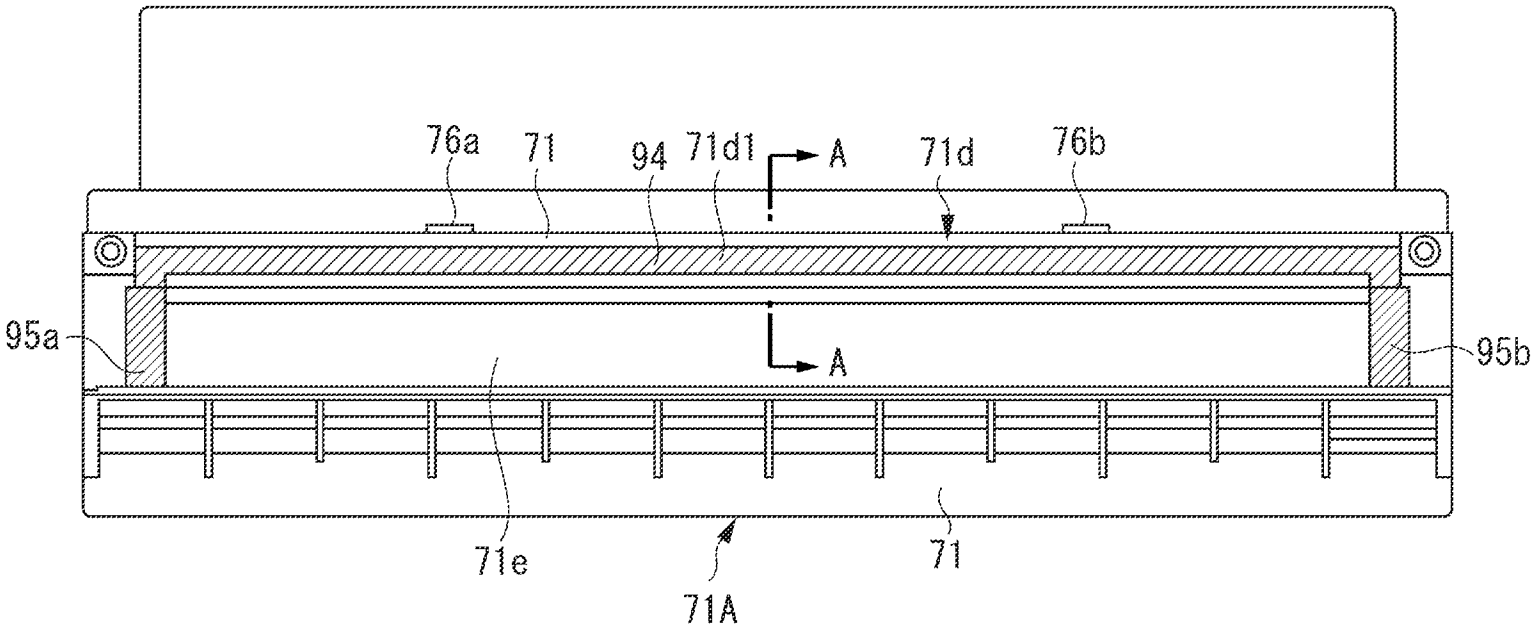
FIG. 6 is a schematic front view after molding the development blade seal of the development frame member unit in the developing unit.
Figure 7:
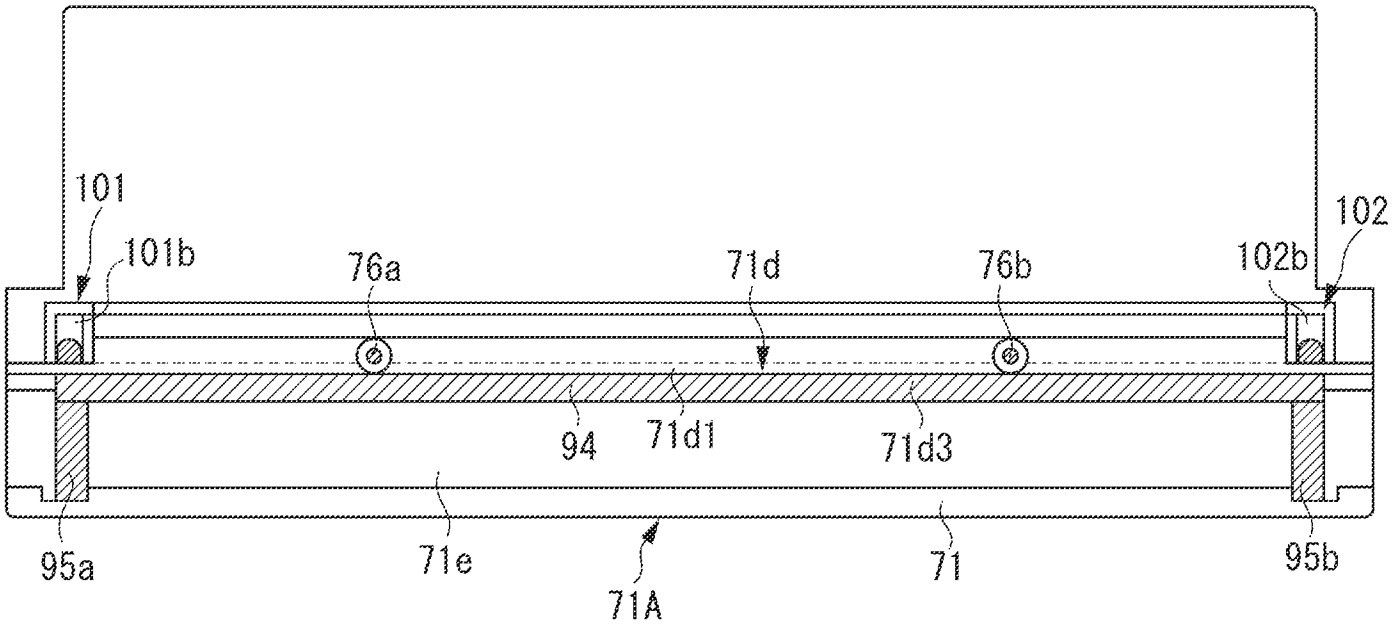
FIG. 7 is a schematic top plan view after molding the development blade seal of the development frame member unit in the developing unit.
Figure 8A:
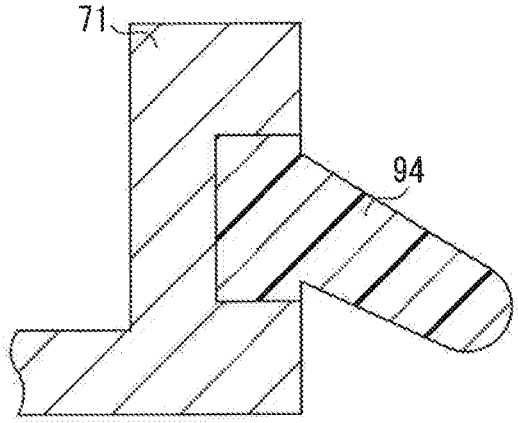
FIGS. 8A and 8B are schematic cross-sectional views of the development blade seal.
Figure 8B:
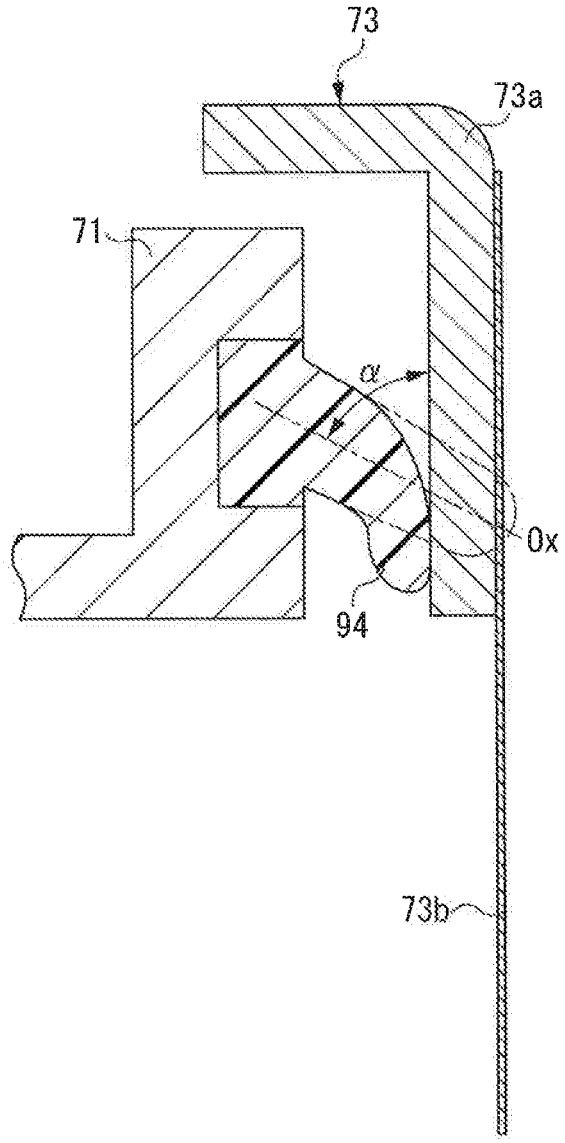

FIG. 3 is a schematic cross-sectional view illustrating a sealing configuration of the development frame member unit in the developing unit. FIG. 4 is a schematic front view before forming the development blade seal (blade sealing member) of the development frame member unit. FIG. 5 is a schematic top plan view before injection-molding the development blade seal of the development frame member unit. FIG. 6 is a schematic front view after injection-molding the development blade seal of the development frame member unit. FIG. 7 is a schematic top plan view after injection-molding the development blade seal of the development frame member unit. FIGS. 8A and 8B are schematic cross-sectional views of the development blade seal.

Figure 2:
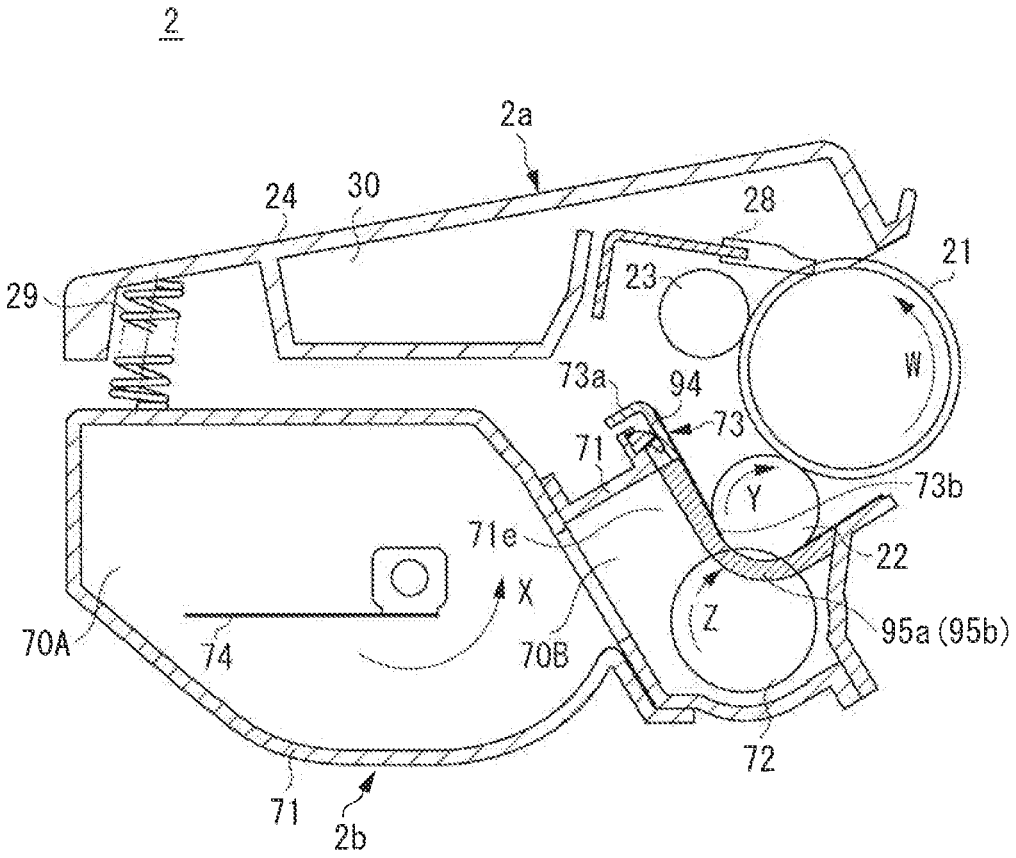
FIG. 2 is a schematic cross-sectional view of a process cartridge according to the first exemplary embodiment of the present invention.

As illustrated in FIG. 3, FIG. 4 and FIG. 5, the development container 70B has an opening 71*e* for supplying the toner which has been accommodated in the toner container 70A illustrated in FIG. 2 to the developing roller 22. The developing roller 22 and the development blade unit 73 that regulates an amount of the toner on the developing roller 22 are arranged in the proximity of the opening 71*e*.

The development blade unit 73 according to the present exemplary embodiment is configured by coupling a development blade 73*b* formed of stainless steel or phosphor bronze to a supporting plate 73*a* formed of steel plate. The supporting plate 73*a* is firmly secured by screws and supported to latch portions 71*b* and 71*c* (see FIG. 4) provided at both end portions of the development frame member 71 forming the development container 70B. The development blade 73*b* may be formed by integrally molding a rubber or the like with the supporting plate 73*a*.

As illustrated in FIG. 3 to FIG. 5, the end sealing members 95*a* and 95*b* for sealing clearances between the development container 70B and a peripheral surface of the developing roller 22 are arranged at both lengthwise end portions of the opening 71*e*. Each of the end sealing members 95*a* and 95*b* is formed of a pile formed by weaving felt or fiber into the surface thereof, or a flexible member such as an electrostatic flocking. According to the present exemplary embodiment, when the developing roller 22 and the development blade unit 73 are mounted on the development frame member 71, a peripheral surface of the developing roller 22 and a back surface of the development blade 73*b* of the development blade unit 73 are pressure-welded to each other. Accordingly, in the developing unit 71A, the end sealing members 95*a* and 95*b* secures a sealing property in the axial direction of the developing roller 22.

At the upper part of the opening 71*e* of the development container 70B, a seal forming portion 71*d* is provided between the end sealing member 95*a* at the one end side and the end sealing member 95*b* at the other end side, in the development frame member 71. The seal forming portion 71*d* has a recessed portion 71*d*1 into which the development blade seal (hereinafter, referred to as a blade seal) 94 made of the elastomer resin is injected, and abutting surfaces 71*d*2 and 71*d*3 against which a sealing mold 83 illustrated in FIGS. 10A and 10B abuts. Further, FIGS. 10A and 10B, as illustrated in FIGS. 11A and 11B, cylindrical injection ports 76*a* and 76*b* which are communicated with the recessed portion 71*d*1 of the seal forming portion 71*d* via holes portions 75*a* and 75*b*, are provided at predetermined lengthwise locations of the development frame member 71. In the present exemplary embodiment, the injection ports 76*a* and 76*b* are provided at two locations arranged at roughly equal distance from the lengthwise center of the seal forming portion 71*d* toward both lengthwise sides. Instead, a configuration of providing one location at the lengthwise central part may be also used, and alternatively, a configuration of providing three or more locations may be used.

Figure 13:
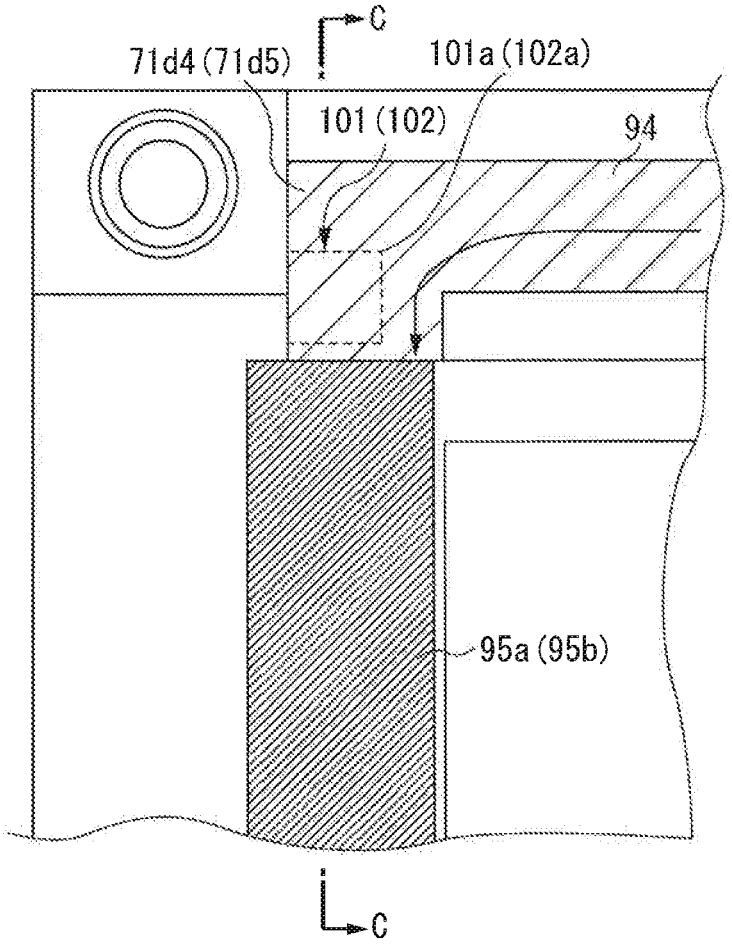
FIG. 13 is a schematic front view of a lengthwise end portion in a state of molding the development blade seal.

As illustrated in FIG. 4, FIG. 5, FIG. 7, FIG. 13, and FIG. 14, a buffer portion 101 is provided at a back side of the seal forming portion 71*d* between the injection port 76*a* and the end sealing member 95*a* at the one end side. The buffer portion 101 includes a communication port 101*a* and a resin reservoir 101*b*, and is connected to the recessed portion 71*d*1 of the seal forming portion 71*d* via a communication port 101*a*. Similarly, a buffer portion 102 including a communication port 102*a* and a resin reservoir 102*b* is also provided at the back side of the seal forming portion 71*d* between the injection port 76*b* and the end sealing member 95*b* at the other end side. The buffer portion 102 is also connected to the recessed portion 71*d*1 of the seal forming portion 71*d* via the communication port 102*a*. In the present exemplary embodiment, positions of the buffer portions 101 and 102 each are provided in the proximity of the end sealing member 95*a* and 95*b*. More specifically, as illustrated in FIG. 13, the buffer portions 101 and 102 are provided at positions at which they overlap with the end sealing members 95*a* and 95*b*, in a direction orthogonal with respect to the lengthwise direction of the developing roller 22. Further, the buffer portions 101 and 102 are provided at bent portions (corner portions) 71*d*4 and 71*d*5 forming a path to the end sealing members 95*a* and 95*b*, and the elastomer resin injected from the injection ports 76*a* and 76*b* of the development frame member 71 may flow in a lengthwise direction of the developing roller 22. Alternatively, the buffer portions 101 and 102 may be provided between the bent portions (corner portions) 71*d*4 and 71*d*5 and the end sealing members 95*a* and 95*b*. Accordingly, the elastomer resin can sufficiently contact the end sealing members 95*a* and 96*a*, thereby close-contact between the end sealing members 95*a* and 96*a* and the blade seal 94 can be secured.

As illustrated in FIG. 6 and FIG. 7, the blade seal 94 serving as a blade sealing member is provided in the recessed portion 71*d*1 of the seal forming portion 71*d* of the development frame member 71. Then, the blade seal 94 provides a sealing relationship between the development frame member 71 and the development blade unit 73, so that the toner does not leak to the outside of the developing unit 71A. In addition, the blade seal 94 brings about intimate contact without producing clearances between the end sealing member 95*a* at the one lengthwise end side and the end sealing member 95*b* at the other lengthwise end side, to provide a sealing relationship therebetween so that the toner does not leak therefrom.

Figure 9A:
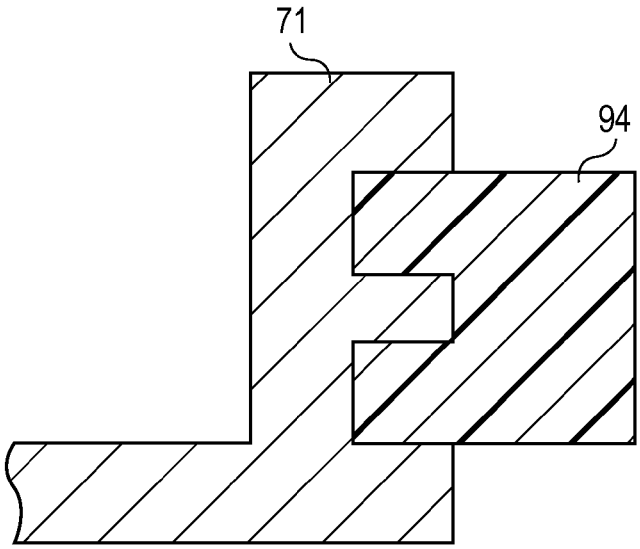
FIGS. 9A and 9B are schematic cross-sectional views of other exemplary embodiments of the development blade seal.
Figure 9B:
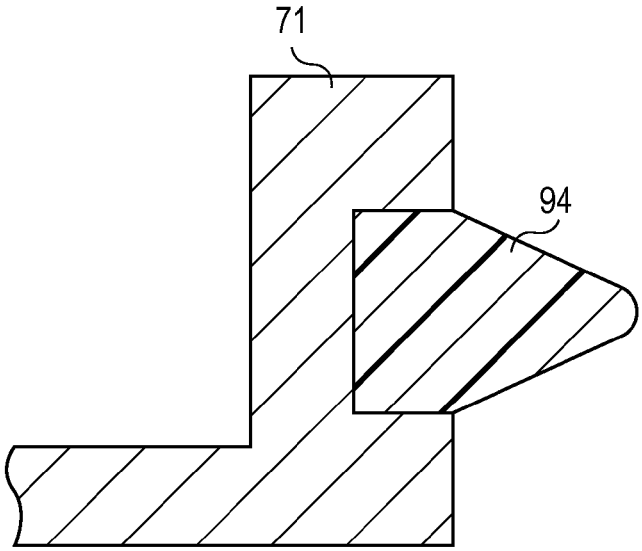

As illustrated in FIGS. 8A and 8B, a cross-sectional shape of the blade seal 94 is a protruding shape having a center axial line Ox thereof inclined at an angle α relative to a seal contact surface of the development blade unit 73. In a state where the development blade unit 73 is mounted to the development frame member 71, as illustrated in FIG. 8B, the blade seal 94 deforms to undergo a deflection between the development frame member 71 and the development blade unit 73, and provides a sealing relationship so that the toner does not leak therefrom. In the present exemplary embodiment, the blade seal 94 is configured to allow deflection by employing a finger shape or curved shape in order to reduce a repulsion force to the development blade unit 73 as practicable as possible. However, as illustrated in FIGS. 9A and 9B, there may be used a configuration in which the blade seal 94 is formed in a rectangular (FIG. 9A) or triangular (FIG. 9B) cross-sectional shape, and is compressively deformed by a predetermined compressive force by the development blade unit 73.

The blade seal 94 is integrally injection-molded into the development frame member 71 using an elastic sealing material. In the present exemplary embodiment, the elastomer resin is used as a material (elastic sealing material) of the blade seal 94. As the elastomer resin, styrene-based elastomer resin made of the same base material as that of the development frame member 71, and having an elasticity is excellent and preferable in disassembly workability (if components have the same material, the need for disassembly of the components each other is eliminated) during recycling of the process cartridge. However, even the elastomer resins except for the above-described material may be used as long as they have the similar mechanical properties, and alternatively, silicone-based rubber or soft rubber or the like may be used. In the present exemplary embodiment, a variety of the above-described elastomer resins and rubbers as elastic sealing materials inclusive are called "elastomer resins".

Now, a step of forming the blade seal 94 will be described with reference to FIGS. 10A and 10B through FIG. 15.

Figure 10A:
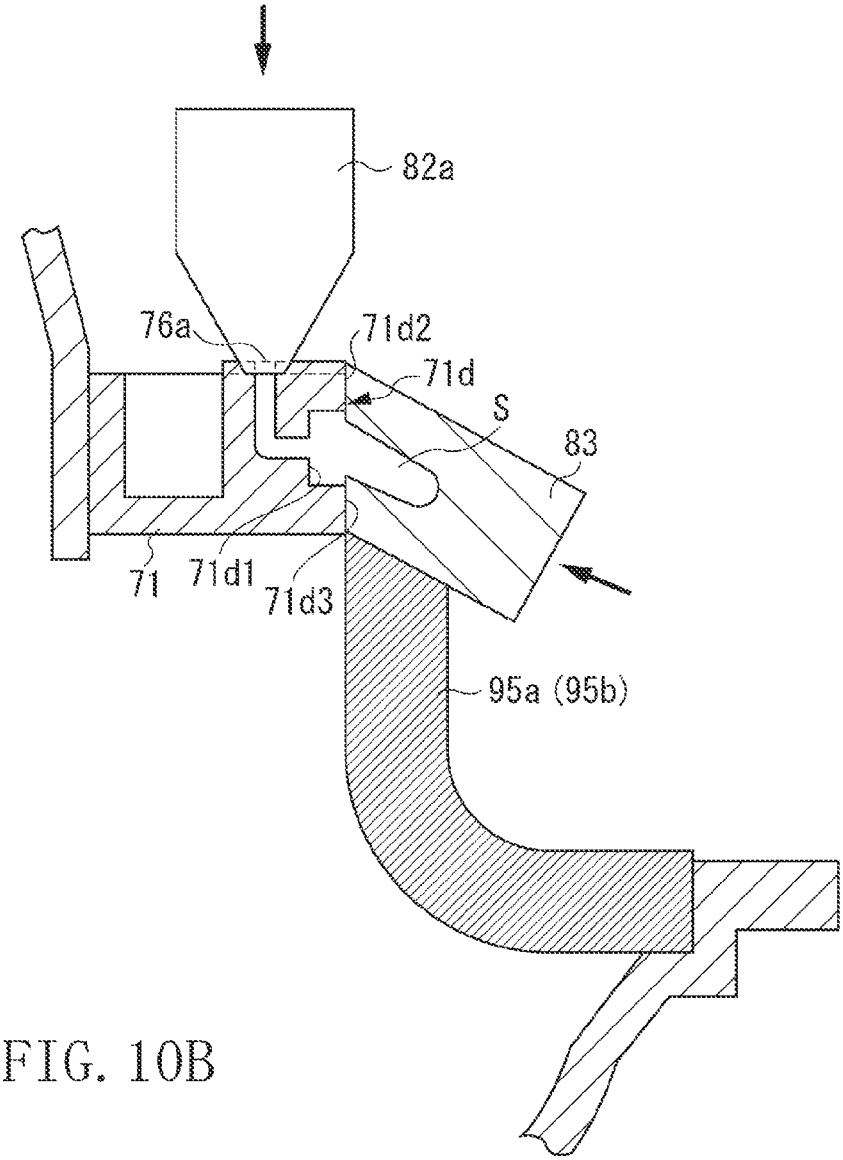
FIGS. 10A and 10B are schematic cross-sectional views of a resin injection portion in a state of clamping a sealing mold of the development frame member unit in the developing unit.
Figure 10B:
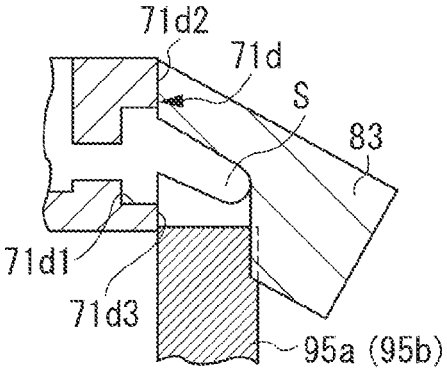
Figure 11A:
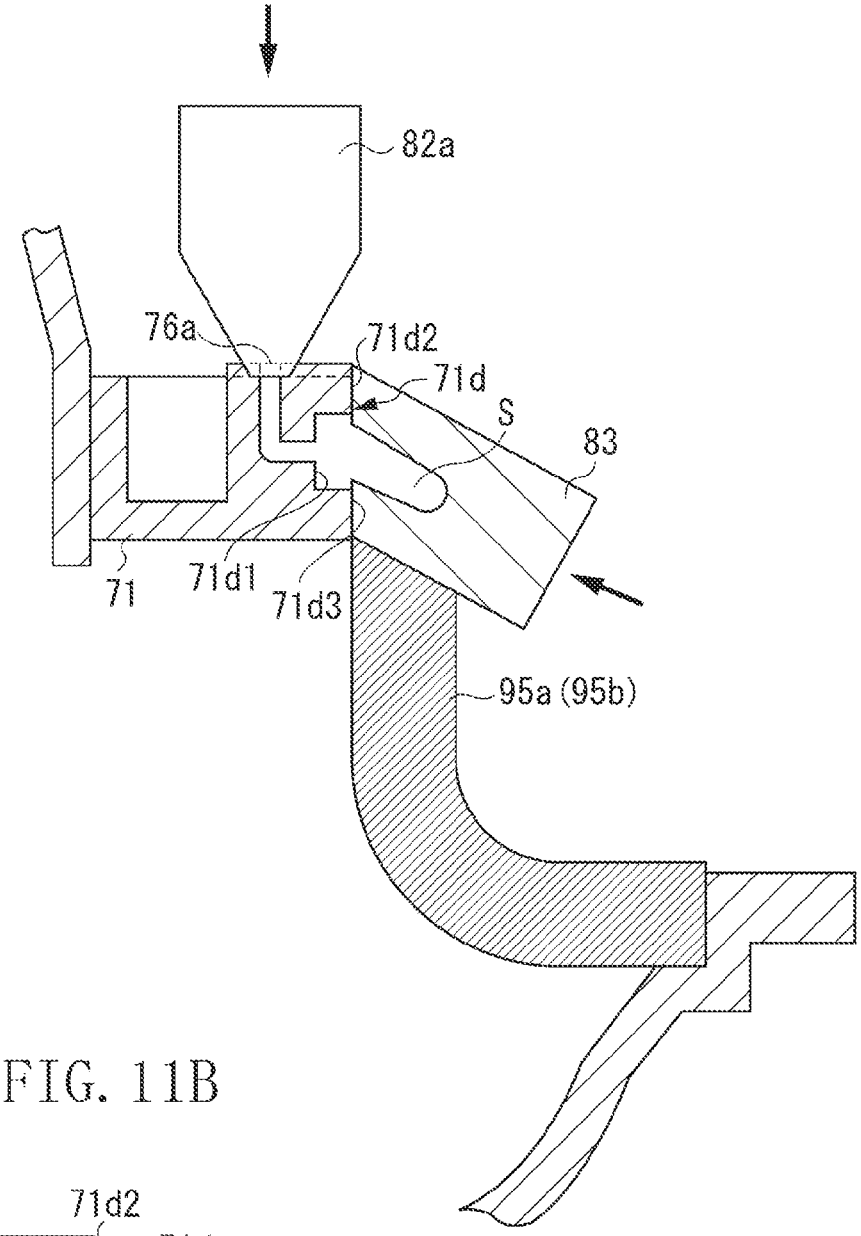
FIGS. 11A and 11B are schematic cross-sectional views when molding the development blade seal of the development frame member unit in the developing unit.
Figure 11B:
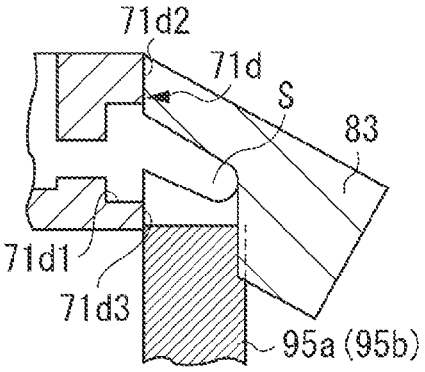
Figure 12:
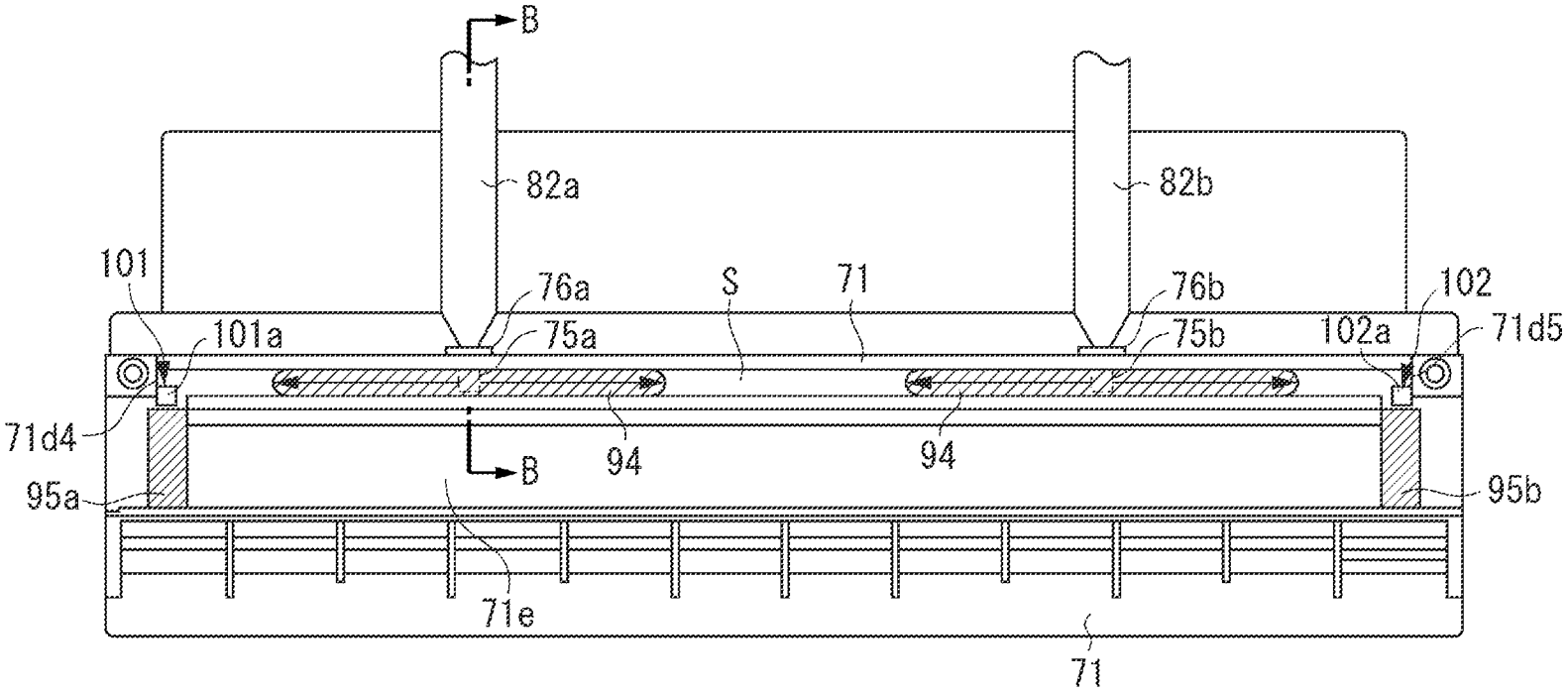
FIG. 12 is a schematic front view when molding the development blade seal.
Figure 14:
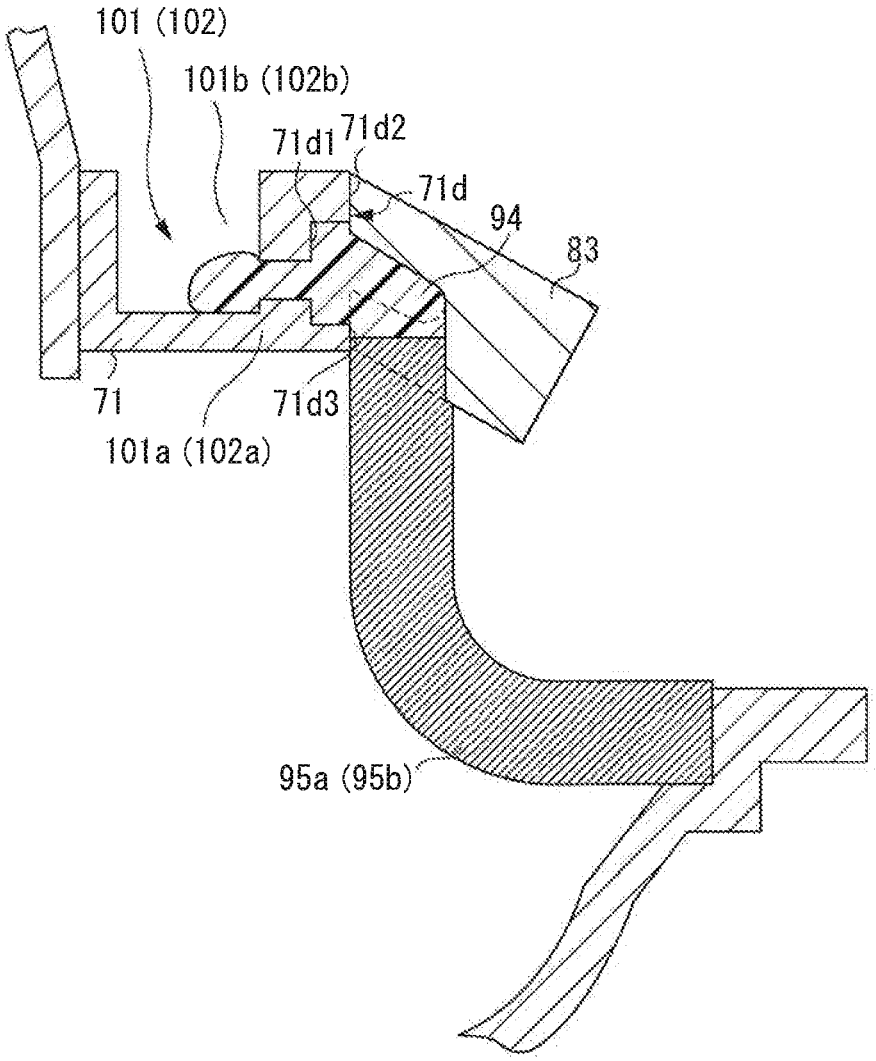
FIG. 14 is a schematic front view of a lengthwise end portion in a state of molding the development blade seal.
Figure 15:
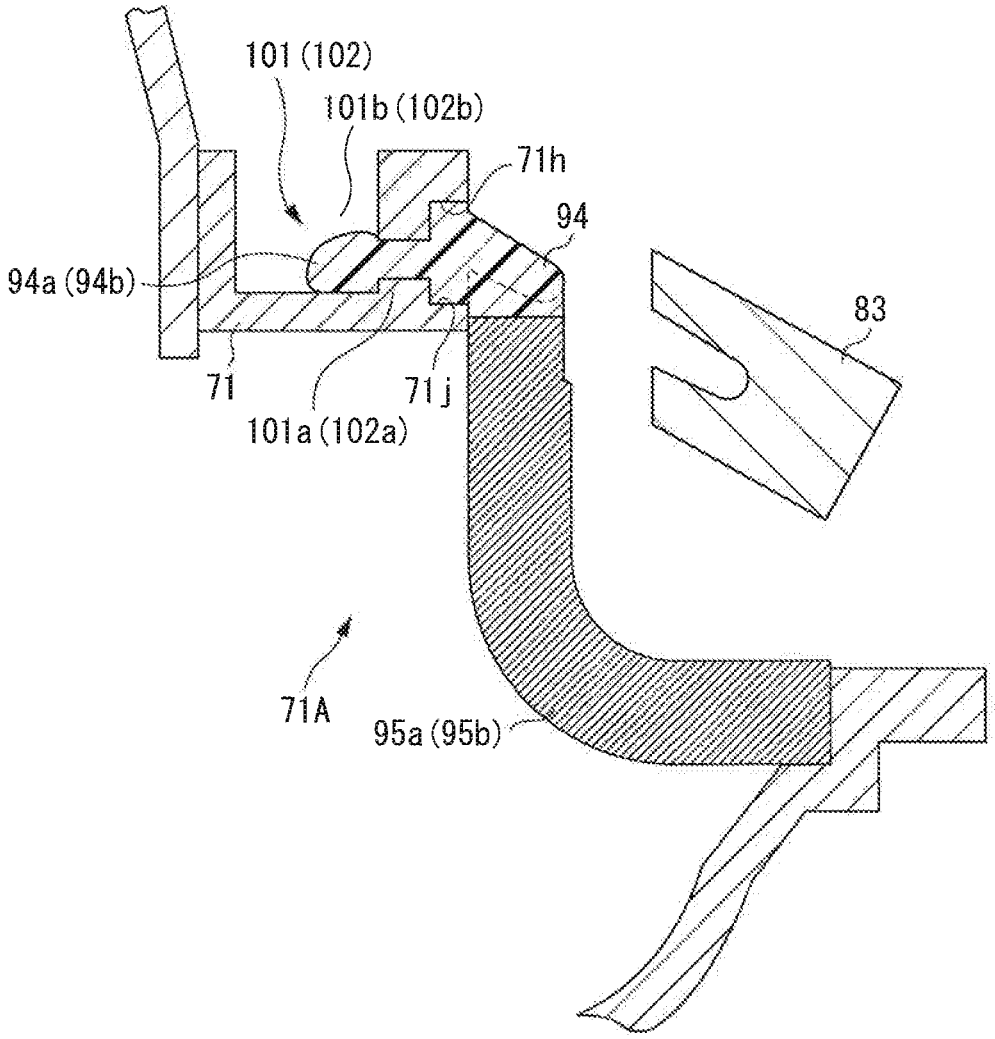
FIG. 15 is a schematic cross-sectional view of a buffer portion of the developing unit.

FIGS. 10A and 10B are schematic cross-sectional views of a resin injection portion in a state where a mold is clamped with respect to the development frame member 71. FIGS. 11A and 11B are schematic cross-sectional views during formation of the blade seal. FIG. 12 is a schematic front view during formation of the blade seal. FIG. 13 is a schematic front view of a lengthwise end portion in a state where the blade seal has been formed. FIG. 14 is a schematic cross-sectional view of the buffer portion of the developing unit. FIG. 15 is a schematic cross-sectional view of the resin injection portion in a state where the sealing mold is opened from the developing unit frame member unit 71A.

First, the end sealing members 95*a* and 95*b* each are assembled at the one lengthwise end side and the other lengthwise end side of the development frame member 71 that forms the development container 70B. Next, as illustrated in FIG. 10A, the sealing mold 83, which has been formed to have a a sealing shape, is clamped to abut against abutting surfaces 71*d*2 and 71*d*3 of the seal forming portion 71*d* of the development frame member 71. At this time, the end sealing members 95*a* and 95*b* at the one end side and the other end side, as illustrated in FIG. 10B, become compressed by a predetermined amount by the sealing mold 83, and thus an intimate contact between the sealing mold 83 and the end sealing members 95*a* and 95*b* is also provided without producing clearances. Then, gates 82*a* and 82*b* of resin injection devices are caused to abut from above against the injection ports 76*a* and 76*b* provided at two lengthwise locations of the development frame member 7. Then, the elastomer resin serving as a sealing material of the blade seal 94 (see FIG. 7) is injected into the injection ports 76*a* and 76*b* of the development frame member 71 from the gates 82*a* and 82*b* of the resin injection devices. Accordingly, as illustrated in FIGS. 11A and 11B, the elastomer resin is poured into a space S surrounded by the recessed portion 71*d*1 of the seal forming portion 71*d* of the development frame member 71 and the sealing mold 83, and the end sealing members 95*a* and 95*b*. The elastomer resin injected from two lengthwise locations, as illustrated in FIG. 12, flows through the spaces S surrounded by the recessed portion 71*d*1 of the seal forming portion 71*d* and the sealing mold 83, and the end sealing members 95*a* and 95*b*, to both lengthwise sides.

The elastomer resin which flows longitudinally, as illustrated in FIG. 13, reaches the end sealing members 95*a* and 95*b* provided both end portions to sufficiently contact the end sealing members 95*a* and 95*b* without producing clearances. After the elastomer resin has reached the end sealing members 95*a* and 95*b* enough to make contact therewith without producing clearances therebetween, as illustrated in FIG. 15, excess portions (squeeze-out portions) 94*a* and 94*b* of the elastomer resin pass through the communication ports 101*a* and 102*a* of the buffer portions 101 and 102, and then flows into the resin reservoirs 101*b* and 102*b* from the recessed portion 71*d*1 of the seal forming portion 71*d*. When the elastomer resin flows into the resin reservoirs 101*b* and 102*b*, the injection-molding operation ends.

In the present exemplary embodiment, the injection-molding operation is performed by a constant amount control scheme for injecting a resin amount approximately matching an amount of the elastomer resin that flows into the buffer portions 101 and 102. That is, in addition to a runner L portion from the injection port (gate) 76*a* to a groove 71*d*1 illustrated in FIGS. 11A and 11B, the elastomer resin of an amount greater than a volume of the space S is injected. For this reason, the injection amount is set at an amount approximately matching an amount of the squeeze-out portions 94*a* and 94*b* of the elastomer resin that flows into the resin reservoirs 101*b* and 102*b*, after passing through the communication ports 101*a* and 102*a*. Accordingly, a shape of the blade seal 94 can be molded without substantial variations, and sealing between the development frame member 71 and the development blade 73 can be reliably provided. Furthermore, the elastomer resin can be in contact with the end sealing members 95*a* and 95*b* without producing clearances, by providing the communication ports 101*a* and 102*a* at a position illustrated in FIG. 13, and sealing can be reliably provided.

In addition, a scheme may be used for ending the injection by detecting the squeeze-out portions 94*a* and 94*b* of the elastomer resin that have flown into the resin reservoirs 101*a* and 102*b*, by a sensor or the like.

The communication ports 101*a* and 102*a* are provided in the proximity of the end sealing members 95*a* and 95*b* which are located at the end side of a flow passage of the elastomer resin. Therefore, the elastomer resin, after having made contact with the end sealing members 95*a* and 95*b*, flows into the communication ports 101*aa* and 102*a*, and then to the resin reservoirs 101*b* and 102*b*. Also, sizes of cross-sectional areas of the communication ports 101*a* and 102*a* are made smaller than an area of a bottom surface of the groove 71*d*1. Therefore, the elastomer resin, after having come into contact with the end sealing members 95*a* and 95*b* earlier, can be made to flow to the communication ports 101*a* and 102*a* with a narrow flow route, then to flow into the resin reservoirs 101*b* and 102*b*. In the present exemplary embodiment, the buffer portions 101 and 102 are provided at aback surface side of the seal forming portion 71*d*, that is, at an opposite side to the developing roller 22 with respect to the seal forming portion 71*d*. For this reason, a resin of excess portion which has squeezed out into the resin reservoirs 101*b* and 102*b* is prevented from coming into contact with the developing roller 22 or the like, and there is no need to perform post-treatment of the squeezed-out elastomer resin.

After the injection of the elastomer resin has ended as described above, when the sealing mold 83 is opened as illustrated in FIG. 15, the blade seal 94 is injection-molded into the development frame member 71 of the development container 70B. When the sealing mold 83 is opened, an intimate contacting force acting between surfaces 71*h* and 71*j*, which form the recessed portion 71*d*1 of the seal forming portion 71*d*, and the blade seal 94 generates a force in a shear direction relative to an opening direction of the sealing mold 83. For this reason, the blade seal 94 remains at the development frame member 71, and is not carried away therefrom while mounting to the sealing mold 83 side. As a result, the blade seal 94 becomes securely formed to the seal forming portion 71*d* of the development frame member 71.

Although a molding method of the sealing members has been described hereinbefore, the blade seal 94 may be molded with respect to the development frame member 71 by a two-color molding, an insert molding or the like, other than the molding method for the sealing members according to the present exemplary embodiment.

Next, a remanufacturing method for the process cartridge will be described.

The process cartridge 2 in which the toner contained within the toner container 70A has been used up will be recovered and remanufactured. With regard to a remanufacturing operation, disassembled components are inspected, and rejected components, if any, will be replaced with new components or the like as appropriate, and then the remanufacturing operation is performed.

[Separating Step of Photosensitive Member Unit and Developing Unit]

Figure 16:
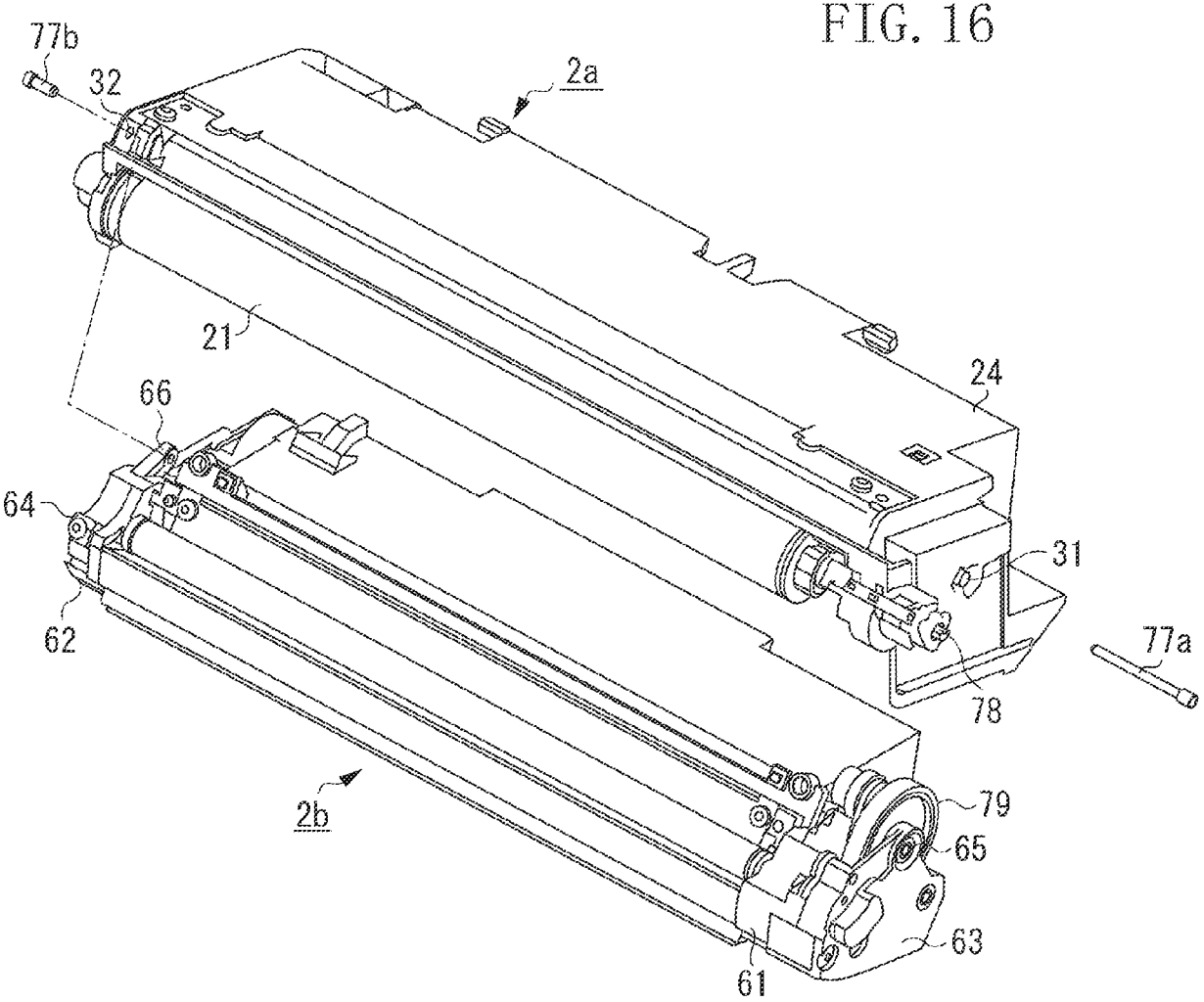
FIG. 16 is an explanatory view of pulling-out of coupling pins of the photosensitive member unit and the developing unit.

First, a separating step of the photosensitive member unit 2*a* and the developing unit 2*b* from each other will be described with reference to FIG. 16. FIG. 16 is an explanatory view of pulling-out of coupling pins of the photosensitive member unit and the developing unit.

To separate the photosensitive member unit 2*a* and the developing unit 2*b* from each other, coupling pins 77*a* and 77*b* are pulled out from the photosensitive member unit 2*a* with a tool such as pliers. The coupling pins 77*a* and 77*b* are inserted into through-holes 31 and 32 provided in a cleaning frame member 24 of the photosensitive member unit 2*a* and supporting holes 65 and 66 of the side-cover members 63 and 64 of the developing unit 2*b*. Accordingly, the developing unit 2*b* is supported by the photosensitive member unit 2*a*. The coupling pins 77*a* and 77*b* are inserted (i.e., press-fitted) into the through-holes 31 and 32 of the cleaning frame member 24. Therefore, the photosensitive member unit 2*a* and the developing unit 2*b* can be separated from each other by pulling out the coupling pins 77*a* and 77*b*.

[Developing Roller Dismounting Step]

Figure 17:
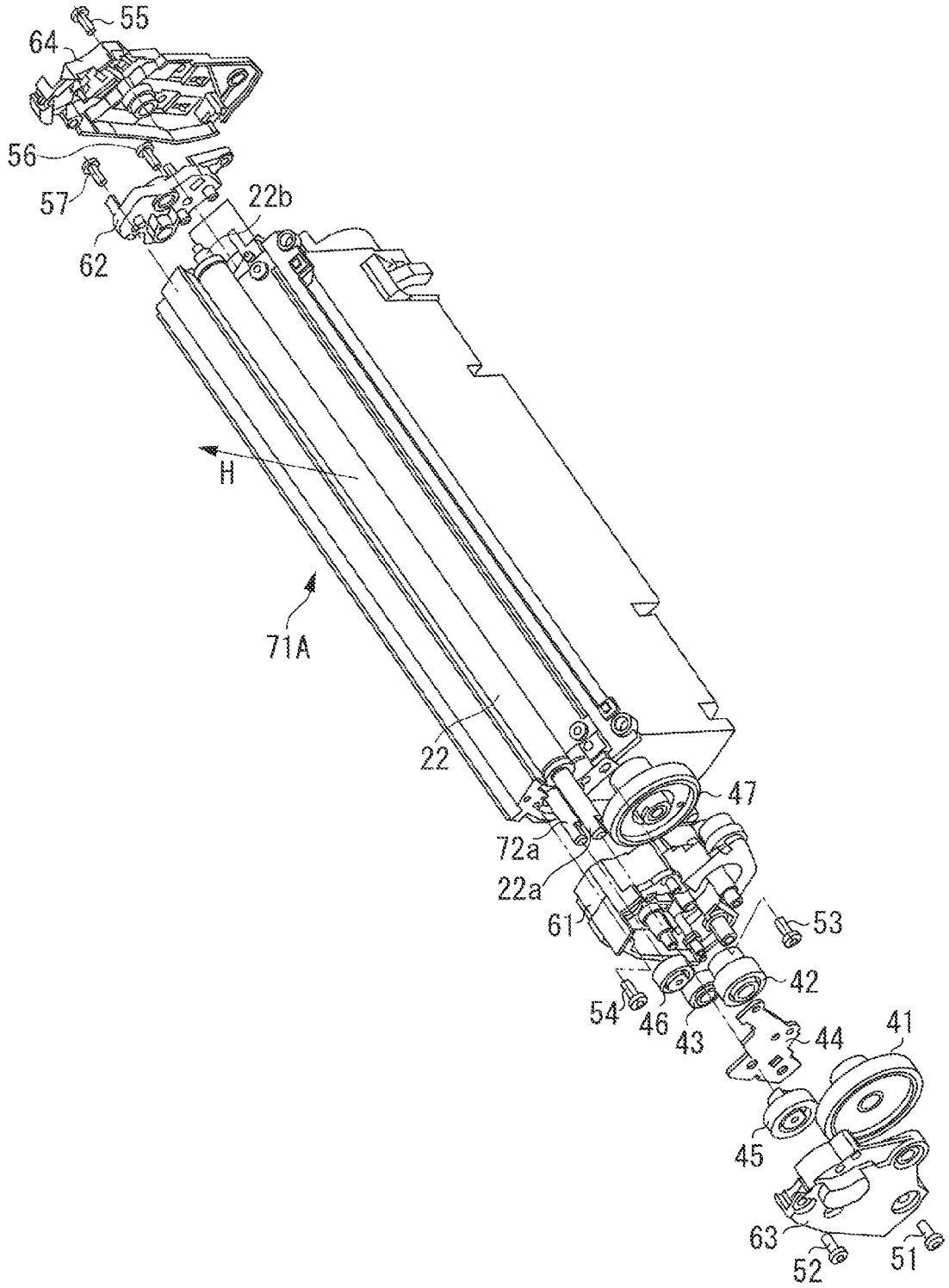
FIG. 17 is a schematic perspective view of a state where the developing roller of the developing unit is dismountably disassembled.

Next, a dismounting step of the developing roller 22 will be described with reference to FIG. 17. FIG. 17 is a schematic perspective view of a state where the developing roller 22 of the developing unit 2*b* is dismountably disassembled.

At both lengthwise ends of the development frame member unit 71A of the separated developing unit 2*a*, bearing members 61 and 62 are fastened by screws 53, 54, 56, and 57 respectively. Furthermore, the side-cover members 63 and 64 for the bearing members 61 and 62 are fastened by screws 51, 52, and 55, respectively. First, a drive side (longitudinally right-hand side of the developing unit 2*a* in FIG. 17) will be described. Disconnect the screws 51 and 52 which firmly secure the side-cover member 63 to the bearing member 61, and remove the side-cover member 63 from the bearing member 61. Next, remove a plurality of drive transmission gears 41, 42, and 43 and a gear regulating member 44 from the bearing member 61. Next, remove a developing roller gear 45 from a developing roller shaft 22*a*. Next, remove a toner supply roller gear 46 from the toner supply roller shaft 72*a*. Next, remove the screws 53 and 54 which firmly secure the bearing member 61 to the development frame member unit 71A, and remove the bearing member 61 from the development frame member unit 71A.

Next, a non-drive side (longitudinally left-hand side of the developing unit 2*a* in FIG. 17) will be described. Similarly to the procedure in the above-described drive side, first, remove the screw 55 which firmly secures the side-cover member 64 to the bearing member 62, and remove the side-cover member 64 from the bearing member 62. Next, remove the screws 56 and 57 which firmly secure the bearing member 62 to the development frame member unit 71A, and remove the bearing member 62 from the development frame member unit 71A. From the above configuration, it becomes possible to dismount the developing roller 22 from the developing unit 2*a*, and the dismounting step of the developing roller 22 is terminated by dismounting it in the direction of the arrow H.

[Regulating Member Dismounting Step]

Figure 18:
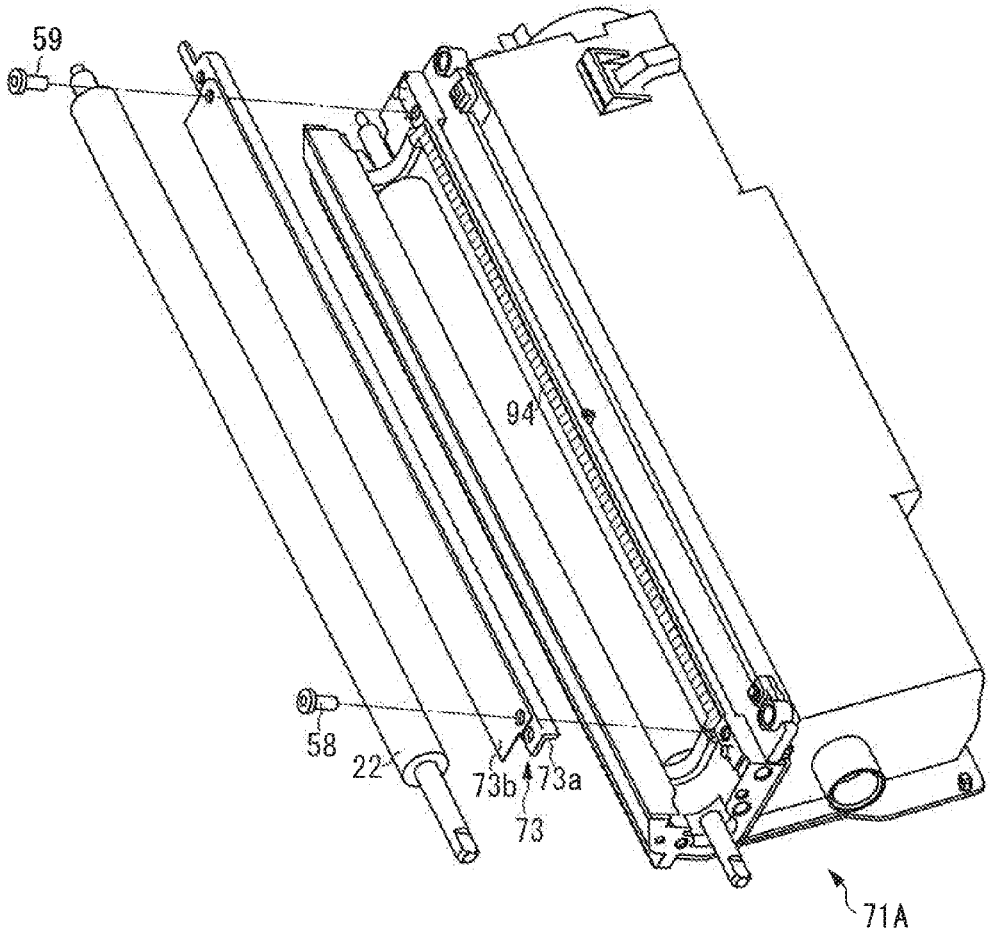
FIG. 18 is a schematic perspective view of a state where the development blade unit is dismounted from the development frame member unit.

Next, a dismounting step of the development blade unit 73 serving as the regulating member will be described with reference to FIG. 18. FIG. 18 is a schematic perspective view of a state where the development blade unit is dismounted from the development frame member unit.

After the developing roller 22, which becomes dismountable through the above-described procedure, has been dismounted, remove the screws 58 and 59 which firmly secure the development blade unit 73 to the development frame member unit 71A. Then, dismount the development blade unit 73 from the development frame member unit 71A. After completion of the above procedure, the dismounting step of the development blade unit 73 ends.

[Sealing Member Cleaning Step]

Figure 19:
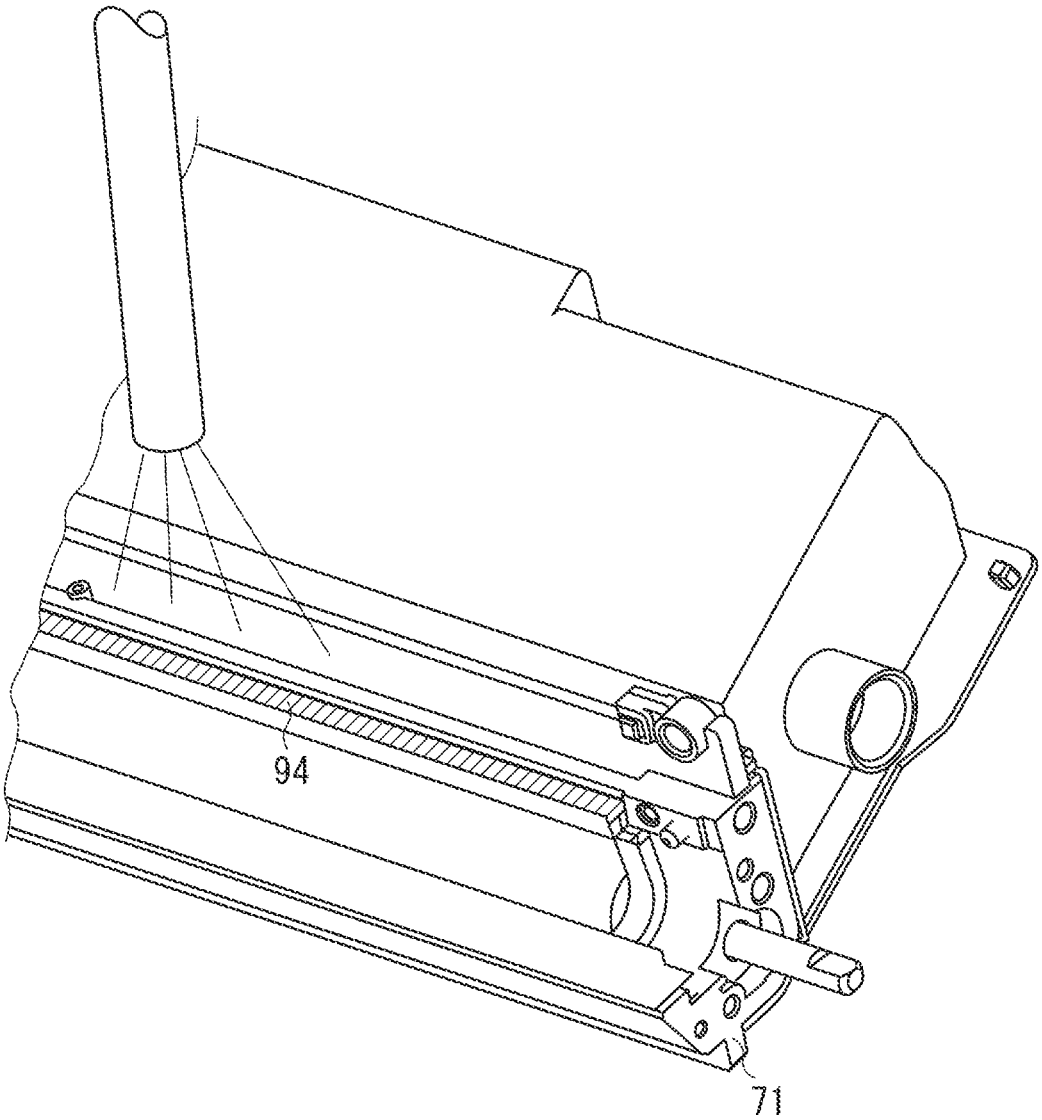
FIG. 19 is a schematic explanatory view of a cleaning step of the development blade seal.

Next, a cleaning step of the blade seal 94 will be described with reference to FIG. 19. FIG. 19 is a schematic explanatory view of the sealing member cleaning step.

The blade seal 94 is a sealing member in a protruding shape formed to the development frame member 71 by injection-molding the elastomer resin, as described above. The blade seal 94 can be recycled by cleaning the toner adhered onto the surface. The adhered toner is cleaned off the blade seal 94 by air blowing or wiping off with a cloth dampened with alcohol. After completion of the above procedure, the cleaning step of the blade seal 94 ends.

[Developer Refilling Step]

Figure 20:
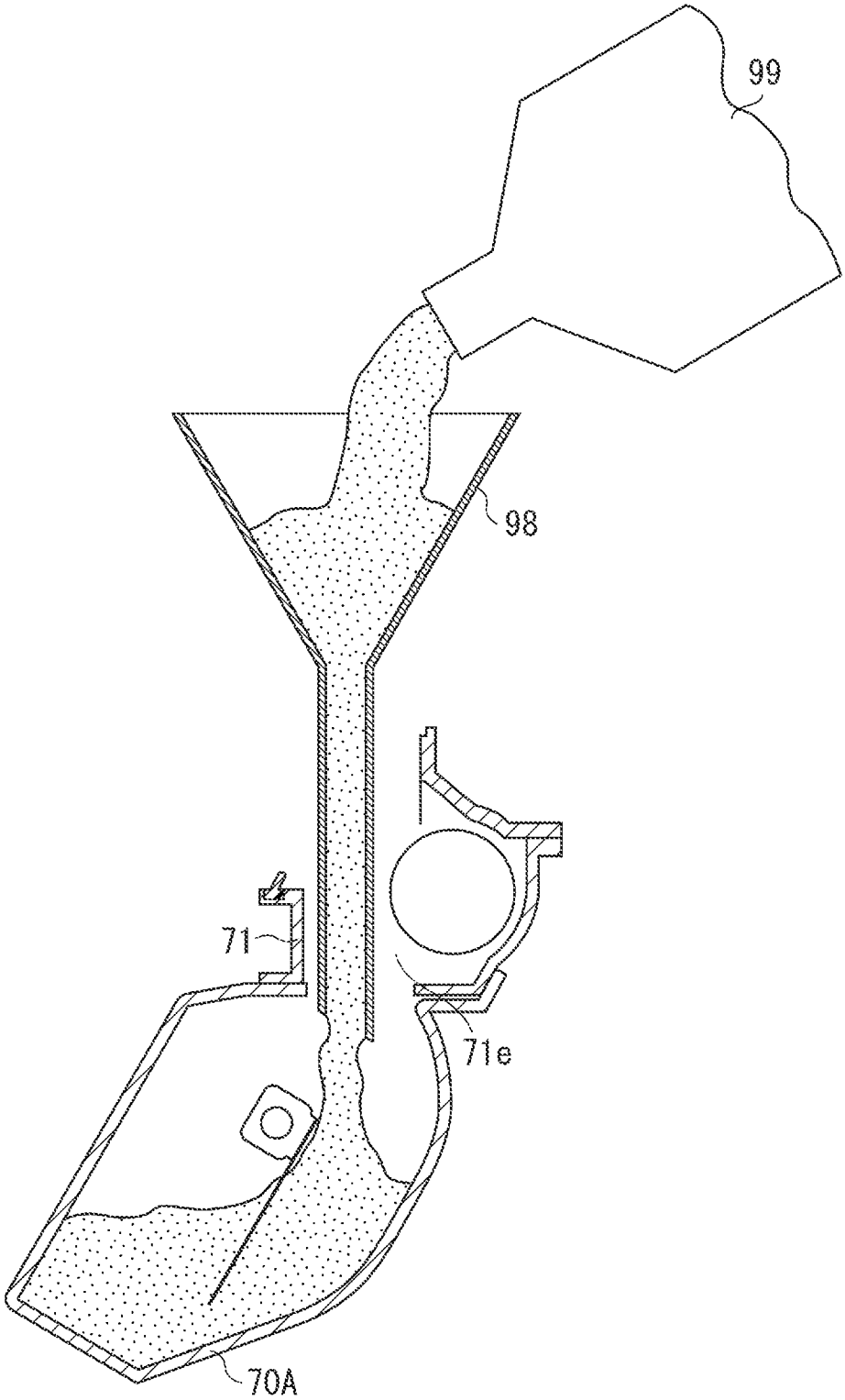
FIG. 20 is a schematic explanatory view of a refilling step of a toner to the development frame member unit.

Next, a developer (toner) refilling step will be described with reference to FIG. 20. FIG. 20 is a schematic explanatory view of a toner refilling step to the development frame member unit.

Filling operation of the toner is performed while holding the development frame member unit 71A at an angle by turning the opening 71*e* up and the toner container 70A down. The toner filling operation is performed by inserting a tip of a funnel (hopper) 98 into the opening 71*e*, and letting the toner to drop into the funnel 98 from a toner bottle 99. A constant amount supply device provided with an auger in a funnel-shaped main body may be employed, and replenishment of the toner can be efficiently performed. After completion of the above procedure, the refilling step of the toner ends.

[Regulating Member Mounting Step]

After the toner refilling ends, as a reassembly of the developing unit 2*b*, first, a mounting step of the development blade unit 73 as the regulating member will be described. The mounting step is performed in a reverse procedure to the procedure of the development blade unit disassembly. Therefore, descriptions will be given with reference to FIG. 18.

The development blade unit 73, which has been previously dismounted, is cleaned, for example, by air blowing away the toner adhered to the development blade 73*a*. Next, the development blade unit 73 is fastened with screws to a predetermined position of the development frame member unit 71A. At this time, the development blade unit 73 causes the blade seal 94 to be deformed to deflect between the development frame member 71 and the development blade unit 73, and is fastened with the screws 58 and 59 to the development frame member unit 71A. After completion of the above procedure, the mounting step of the development blade unit 73 ends.

Hereinafter, the developing unit 2*b* is assembled according to the reverse procedure to the disassembly procedure of the developing unit 2*b*. The developing roller 22, which has been previously dismounted, is cleaned, for example, by air blowing off the adhered toner. Then, inspection of the developing roller 22 is performed, and if it is rejected, it is replaced with new roller as appropriate. Also, the developing roller gear 45, the toner supply roller gear 46, the plurality of drive transmission gears 41, 42, and 43, the gear regulating member 44, the bearing members 61 and 62, and the side-cover members 63 and 64 are also similarly processed. That is, with regard to components with adhered toner, they are cleaned by air blowing or the like, and are subjected to inspection. With regard to components rejected in the inspection, they are replaced with new components as appropriate, and are mounted according to the reverse procedure to the procedure employed during disassembly of the developing unit.

Figure 21:
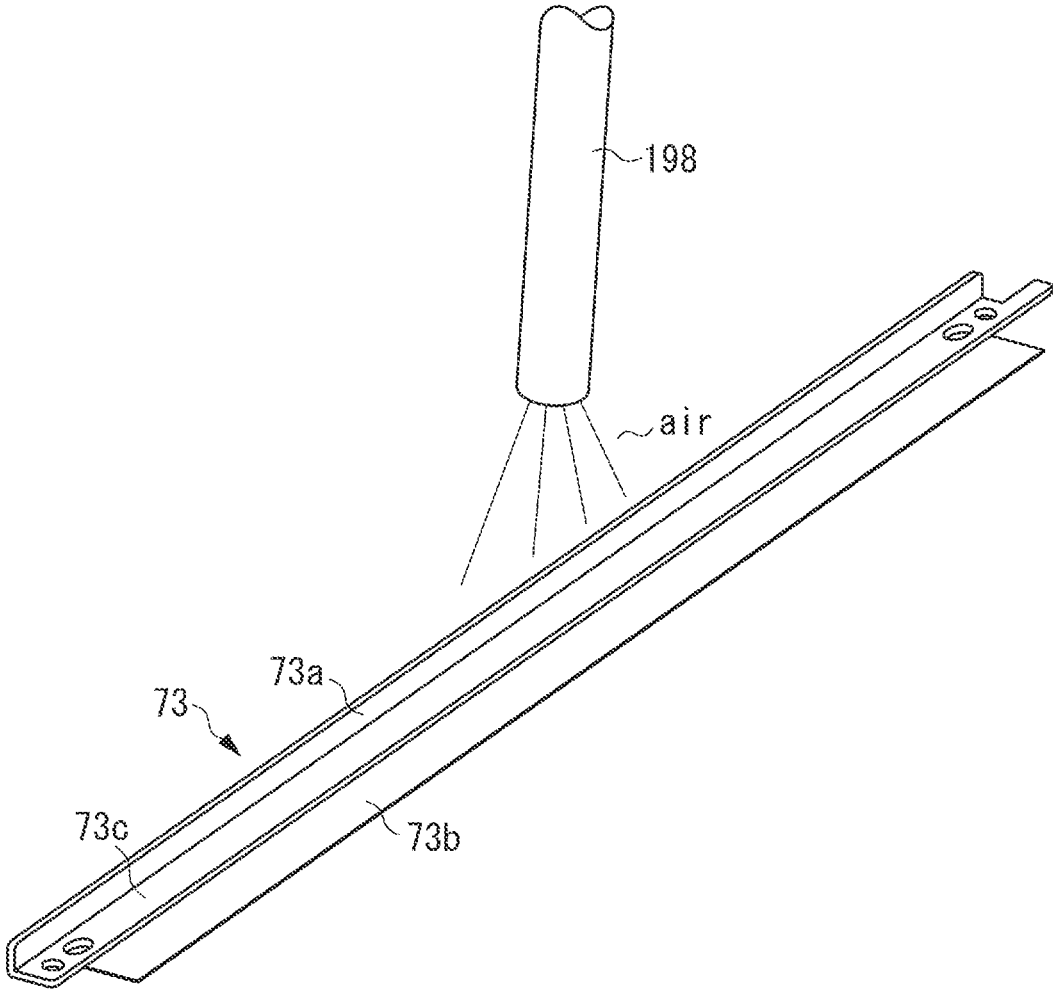
FIG. 21 is a schematic explanatory view of a cleaning step of the development blade unit according to a second exemplary embodiment of the present invention.
Figure 22:
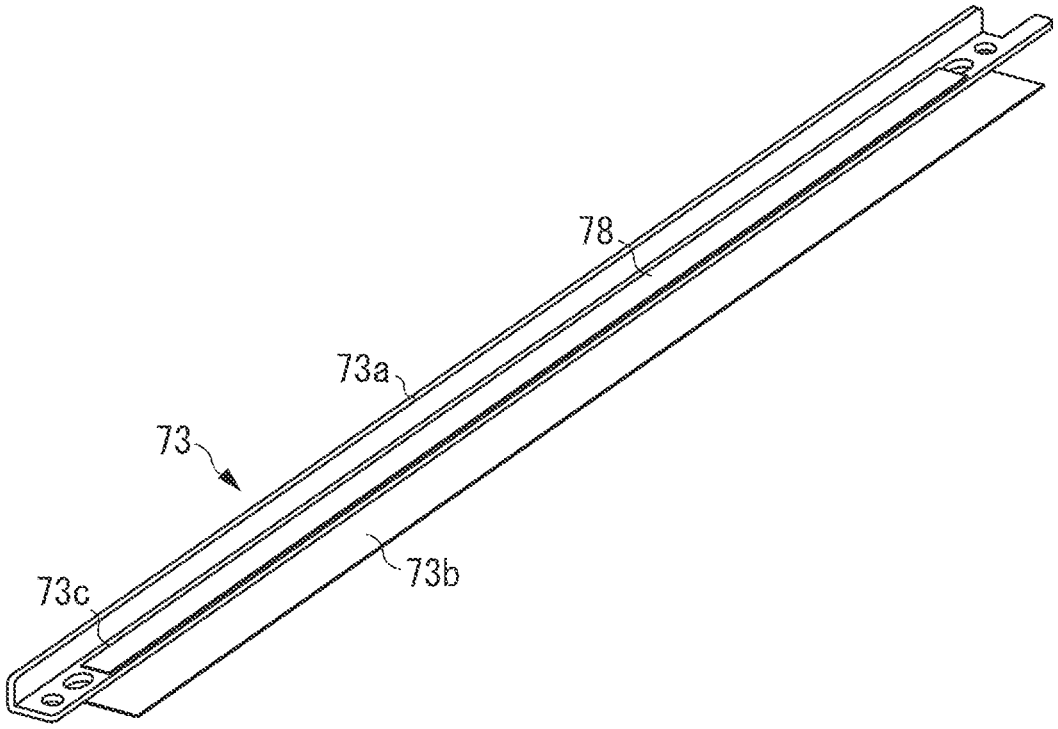
FIG. 22 is a schematic perspective view of a state where an adhesive member is stuck to the development blade unit in the second exemplary embodiment.
Figure 23:
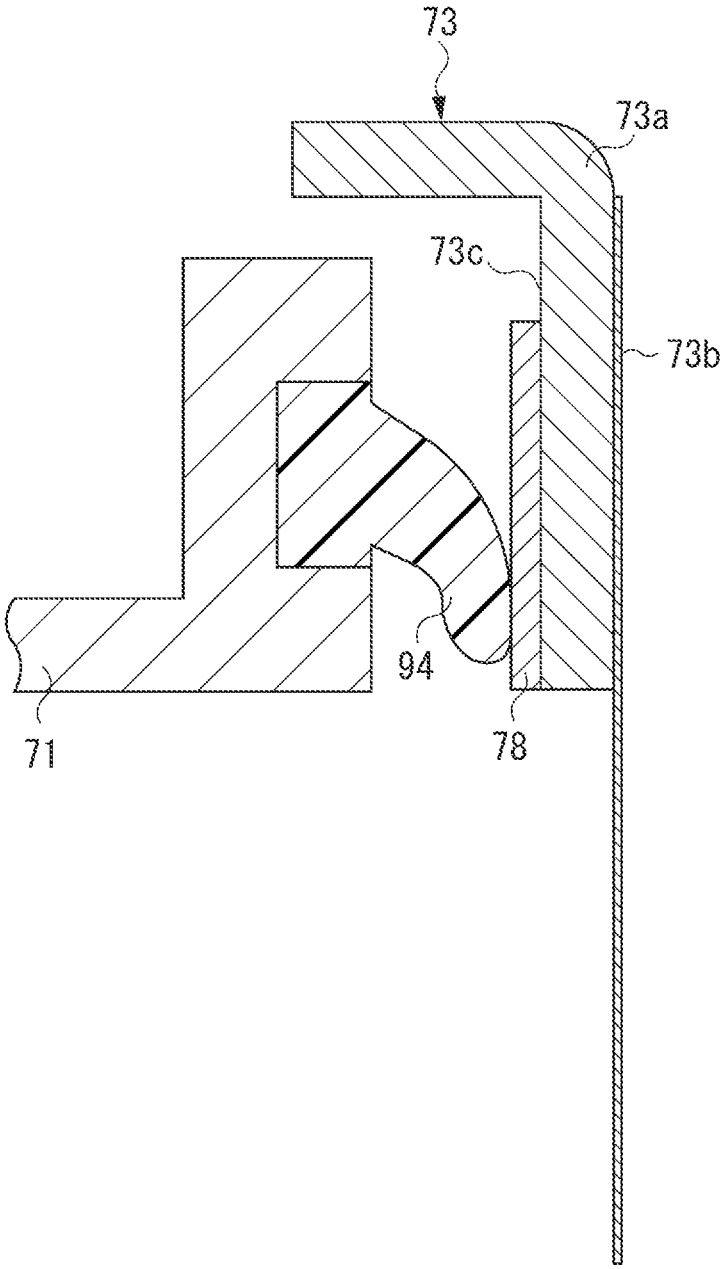
FIG. 23 is a schematic cross-sectional view of a state where the development blade unit is mounted to the development frame member unit in the second exemplary embodiment.

Next, a second exemplary embodiment according to the present invention will be described with reference to FIGS. 21 and 22. FIG. 21 is a schematic explanatory view of the regulating member cleaning step. FIG. 22 is a schematic perspective view of a state where the adhesive member is stuck to the development blade unit. FIG. 23 is a schematic cross-sectional view of a state where the development blade unit according to the second exemplary embodiment is mounted to the development frame member unit.

[Regulating Member Cleaning Step]

As illustrated in FIG. 21, a surface 73*c* which comes into contact with the blade seal 94 of the dismounted development blade unit 73 is cleaned by air blowing off the adhered toner using an air gun 198, or wiping it off with a cloth dampened with alcohol. After completion of the above procedure, the cleaning step of the development blade unit ends.

[Adhesive Member Attaching Step to Development Blade Unit]

Next, as illustrated in FIG. 22, a double-sided tape 78 as the adhesive member is stuck to the cleaned surface 73*c* of the development blade unit 73. After completion of the above procedure, the adhesive member attaching step to the development blade unit 73 ends.

Similarly to the previous descriptions, after having performed the toner refilling operation, the development blade unit 73 is mounted. As illustrated in FIG. 23, the development blade unit 73 causes the blade seal 94 to be deformed to deflect between the development frame member 71 and the development blade unit 73, and is mounted onto the development frame member unit 71A. Also, the blade seal 94 comes into contact with the double-sided tape 78 of the development blade unit 73. An intimate contact state between the blade seal 94 and the development blade unit 73 becomes strong via the double-sided tape 78. Therefore, prevention of the leakage of the toner to the outside of the developing unit 2*b* is enhanced.

In the present exemplary embodiment, the cleaning step of the blade seal 94 is not essential. However, if toner leaks, when dismounting operation of the development blade unit 73, or mounting operation of the development blade unit 73 is performed, cleaning measures are taken as appropriate. In the present exemplary embodiment, the double-sided tape 78 is used as the adhesive member, but styrene-based elastomer resin having an adhesion with the same material as that of the blade seal 94 may be used. Configurations and methods other than those described above are similar to those in the first exemplary embodiment.

Figure 24:
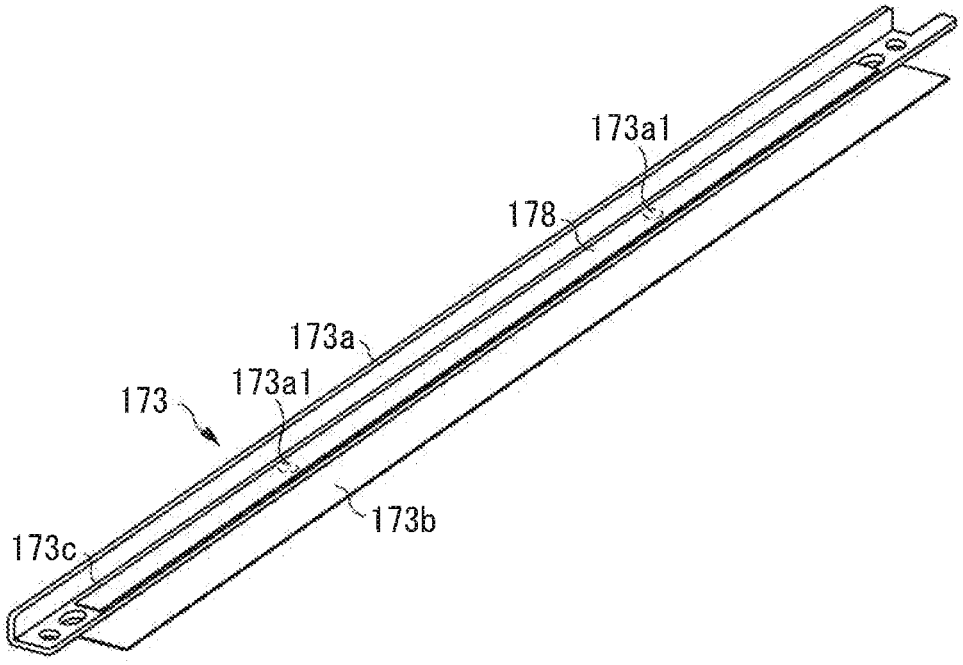
FIG. 24 is a schematic perspective view of a new development blade unit having mounted thereto an adhesive member according to a third exemplary embodiment of the present invention.
Figure 25:
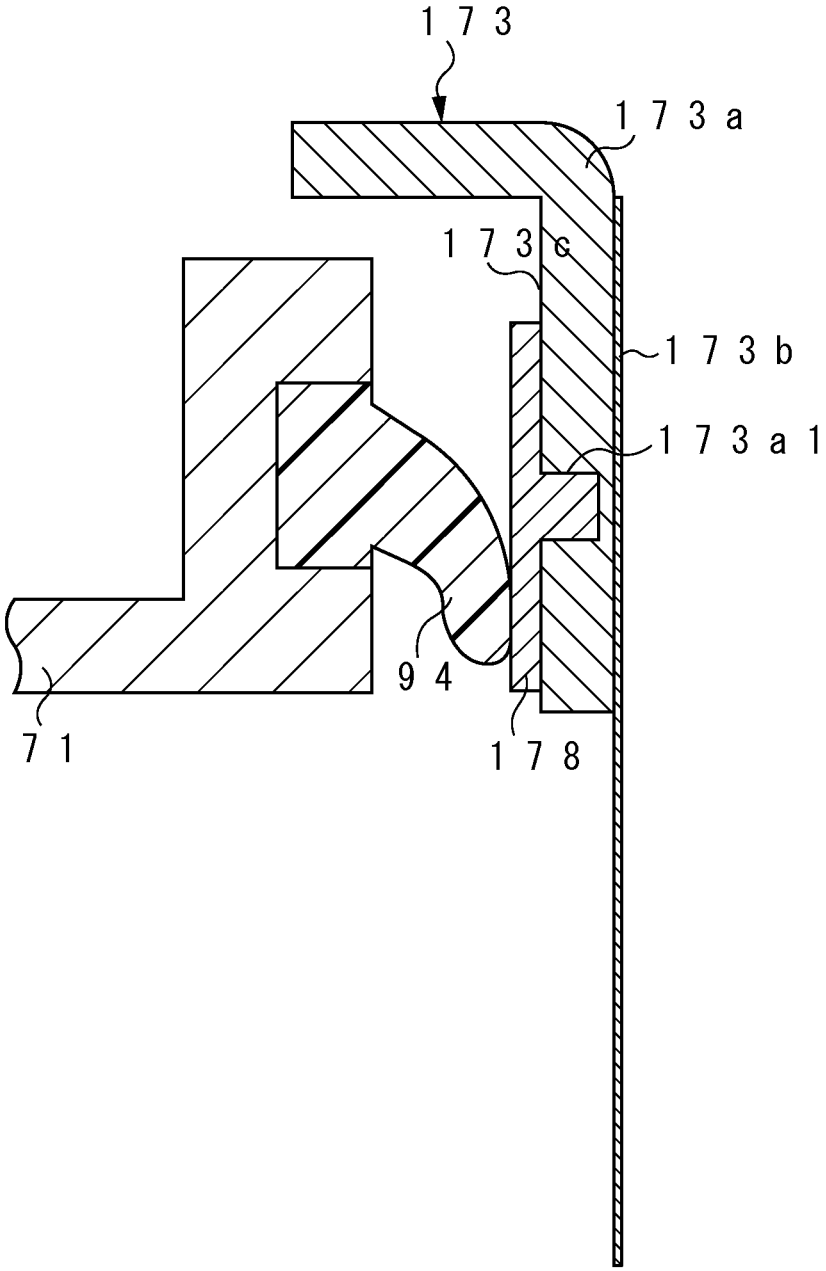
FIG. 25 is a schematic cross-sectional view of a state where the development blade unit is mounted to the development frame member unit in the third exemplary embodiment.

Next, a third exemplary embodiment of the present invention will be described with reference to FIGS. 24 and 25. FIG. 24 is a schematic perspective view of a new development blade unit to which the adhesive member has been attached. FIG. 25 is a schematic cross-sectional view of a state where the development blade unit according to the third exemplary embodiment is mounted on the development frame member unit.

In the present exemplary embodiment, the development blade unit is not recycled like the first and the second exemplary embodiments, but a new development blade unit 173 is used, to which the adhesive member is attached as illustrated in FIG. 24.

Also, in the present exemplary embodiment, the adhesive member 178 may be a double-sided tape, or styrene-based elastomer resin having an adhesion with the same material as the blade seal 94. In a case where the styrene-based elastomer resin is used, the elastomer resin 178 may be attached by injection molding it to a supporting plate 173*a*, as illustrated in FIG. 25. At this time, if holes 173*a*1 are provided at a plurality of locations on the supporting plate 173*a*, the elastomer resin 178 enters into the holes 173*a*1, and the position thereof is never displaced along the supporting plate 173*a*.

Configurations and methods other than those described above are similar to those in the first exemplary embodiment. As described above, according to the exemplary embodiments of the present invention, the developing device and the process cartridge can be remanufactured in a simple manner, and the leakage of the toner to the outside of the developing device can be prevented.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-114478 filed May 18, 2010 and No. 2011-083782 filed Apr. 5, 2011, which are hereby incorporated by reference herein in their entirety.

What is claimed is:

1. A remanufacturing method for a developing device, the developing device including:

a developing roller for developing an electrostatic latent image formed on a photosensitive member by using a developer;

a developer accommodating unit configured to accommodate the developer;

a regulating member configured to regulate a layer thickness of the developer applied on the developing roller;

a development frame member configured to support the regulating member, the development frame member having end sealing members provided at each end side thereof and abutting against a surface of the developing roller to prevent the developer from leaking; and a blade sealing member configured to seal between the regulating member and the development frame member to prevent the developer from leaking, the blade sealing member being configured to be molded by injecting elastomer resin into a seal forming portion of the development frame member and a mold from an injection port thereby contacting each of the end sealing members, the remanufacturing method comprising:

(i) dismounting the regulating member from the development frame member;

(ii) attaching, to the regulating member, an adhesive member which comes into contact with the blade sealing member when the regulating member is mounted to the development frame member; and (iii) mounting the regulating member to the development frame member so as to sandwich the adhesive member between the blade sealing member and the regulating member.

2. The remanufacturing method according to claim 1, further comprising:

cleaning a surface of the regulating member to which the adhesive member is attached, between the regulating member dismounting and the adhesive member attaching.

3. The remanufacturing method according to claim 1, further comprising:

refilling a developer to the developer accommodating unit between the regulating member dismounting and the regulating member mounting.

4. The remanufacturing method according to claim 1, wherein the adhesive member is a double-sided tape.

5. The remanufacturing method according to claim 1, wherein the adhesive member is an elastomer resin.

6. A remanufacturing method for a process cartridge, the process cartridge including:

a photosensitive member unit having a photosensitive member; and a developing unit coupled to the photosensitive member unit, the developing unit having a developing roller for developing an electrostatic latent image formed on the photosensitive member by using a developer, a developer accommodating unit configured to accommodate the developer, a regulating member configured to regulate a layer thickness of the developer applied on the developing roller, a development frame member configured to support the regulating member, the development frame member having end sealing members provided at each end side thereof and abutting against a surface of the developing roller to prevent the developer from leaking, and a blade sealing member configured to seal between the regulating member and the development frame member to prevent the developer from leaking, the blade sealing member being configured to be molded by injecting elastomer resin into a seal forming portion of the development frame member and a mold from an injection port thereby contacting each of the end sealing members, the remanufacturing method comprising:

(i) separating the photosensitive member unit and the developing unit from each other;

(ii) dismounting the regulating member from the development frame member after the separating;

(iii) attaching, to the regulating member, an adhesive member which comes into contact with the blade sealing member when the regulating member is mounted to the development frame member, after the regulating member dismounting;

(iv) mounting the regulating member to the development frame member, so as to sandwich the adhesive member between the blade sealing member and the regulating member; and (v) coupling the photosensitive member unit and the developing unit together after the regulating member mounting.

7. The remanufacturing method according to claim 6, further comprising:

cleaning a surface of the regulating member to which the adhesive member is attached, between the regulating member dismounting and the adhesive member attaching.

8. The remanufacturing method according to claim 6, further comprising:

refilling a developer to the developer accommodating unit between the regulating member dismounting and the regulating member mounting.

9. The remanufacturing method according to claim 6, wherein the adhesive member is a double-sided tape.

10. The remanufacturing method according to claim 6, wherein the adhesive member is an elastomer resin.

11. A developing device used in an image forming apparatus, the developing device comprising:

a developing roller for developing an electrostatic latent image formed on a photosensitive member by using a developer;

a developer accommodating unit configured to accommodate the developer;

a regulating member configured to regulate a layer thickness of the developer applied on the developing roller;

a development frame member configured to support the regulating member, the development frame member having end sealing members provided at each end side thereof and abutting against a surface of the developing roller to prevent the developer from leaking; and a blade sealing member configured to seal between the regulating member and the development frame member to prevent the developer from leaking, the blade sealing member configured to be molded by injecting elastomer resin into a seal forming portion of the development frame member and a mold from an injection port thereby contacting each of the end sealing members, wherein an adhesive member is disposed by being sandwiched between the blade sealing member and the regulating member.

12. A process cartridge dismountably mountable to an image forming apparatus, the process cartridge comprising:

a photosensitive member;

a developing roller for developing an electrostatic latent image formed on the photosensitive member by using a developer;

a developer accommodating unit configured to accommodate the developer;

a regulating member configured to regulate a layer thickness of the developer applied on the developing roller;

a development frame member configured to support the regulating member, the development frame member having end sealing members provided at each end side thereof and abutting against a surface of the developing roller to prevent the developer from leaking; and a blade sealing member configured to seal between the regulating member and the development frame member to prevent the developer from leaking, the blade sealing member being configured to be molded by injecting elastomer resin into a seal forming portion of the development frame member and a mold from an injection port thereby contacting each of the end sealing members, wherein an adhesive member is disposed by being sandwiched between the blade sealing member and the regulating member.

* * * * *